US006590343B2

(12) United States Patent
Pederson

(10) Patent No.: US 6,590,343 B2
(45) Date of Patent: Jul. 8, 2003

(54) LED COMPENSATION CIRCUIT

(75) Inventor: John C. Pederson, St. Cloud, MN (US)

(73) Assignee: 911EP, Inc., DE (US)

( * ) Notice: Subject to any disclaimer, the term of this patent is extended or adjusted under 35 U.S.C. 154(b) by 16 days.

(21) Appl. No.: 09/875,711

(22) Filed: Jun. 6, 2001

(65) Prior Publication Data

US 2002/0047631 A1 Apr. 25, 2002

Related U.S. Application Data

(60) Provisional application No. 60/209,766, filed on Jun. 6, 2000.

(51) Int. Cl.[7] ..... H01K 7/00

(52) U.S. Cl. ..... 315/76; 315/291; 315/316

(58) Field of Search ..... 315/291, 292, 315/228, 316, 362, 77, 307, 312; 363/39, 40; 323/207

(56) References Cited

U.S. PATENT DOCUMENTS

| | | | | |
|---|---|---|---|---|
| 324,921 | A | 3/1885 | Stanuch et al. | |
| 3,701,043 | A | 10/1972 | Suleeg et al. | 372/50 |
| 3,705,316 | A | 12/1972 | Burrous et al. | 307/311 |
| 3,863,075 | A | 1/1975 | Ironmonger et al. | 250/552 |
| 3,889,147 | A | 6/1975 | Groves | 313/500 |
| 4,149,111 | A | 4/1979 | Coates, Jr. | 315/169.4 |
| 4,243,985 | A | 1/1981 | Quayle | 257/98 |
| 4,298,806 | A | 11/1981 | Herold | 250/504 |
| 4,301,461 | A | 11/1981 | Asano | 362/35 |
| 4,319,306 | A | 3/1982 | Stanuch | 313/499 |
| 4,342,944 | A | 8/1982 | SpringThorpe | 362/267 |
| 4,390,931 | A | 6/1983 | Gorick et al. | 250/205 |
| 4,598,198 | A | 7/1986 | Fayfield | 362/269 |
| 4,615,131 | A | 10/1986 | Wakatake | 40/473 |
| 4,616,225 | A | 10/1986 | Woudenberg | 340/908 |
| 4,630,180 | A | 12/1986 | Muraki et al. | 362/293 |
| 4,630,183 | A | 12/1986 | Fujita | 362/311 |
| 4,633,280 | A | 12/1986 | Takasu | 257/91 |
| 4,654,629 | A | 3/1987 | Bezos et al. | 246/473.3 |
| 4,703,219 | A | 10/1987 | Mesquida | 313/111 |
| 4,716,296 | A | 12/1987 | Bussiere et al. | 250/504 |
| 4,720,835 | A | 1/1988 | Akiba et al. | 372/50 |
| 4,799,135 | A | 1/1989 | Inukai et al. | 362/516 |
| 4,918,497 | A | 4/1990 | Edmond | 257/77 |
| 4,929,866 | A | 5/1990 | Murata et al. | 313/500 |
| 4,935,665 | A | 6/1990 | Murata | 313/500 |
| 4,954,822 | A | 9/1990 | Borenstein | 340/925 |
| 4,965,644 | A | 10/1990 | Kawabata et al. | 257/88 |

(List continued on next page.)

FOREIGN PATENT DOCUMENTS

| | | |
|---|---|---|
| DE | 43 04 216 A1 | 2/1993 |
| DE | 297 12 281 | 5/1997 |
| EP | 0 468 822 A2 | 7/1991 |
| EP | 0 531 184 A1 | 8/1992 |
| EP | 0 531 185 A1 | 8/1992 |
| EP | 0 596 782 A1 | 10/1993 |
| EP | 0 633 163 A1 | 7/1994 |
| EP | 0 709 818 A1 | 5/1996 |
| EP | 0 793 403 A1 | 9/1997 |
| EP | 0 896 898 A2 | 7/1998 |

(List continued on next page.)

*Primary Examiner*—Don Wong
*Assistant Examiner*—Jimmy T. Vu
(74) *Attorney, Agent, or Firm*—Vidas, Arrett & Steinkraus

(57) ABSTRACT

A compensating circuit initially adjusts the electrical parameters for a plurality of light emitting diodes for inclusion within standardized specifications for the electrical system of a light fixture. The compensating circuit includes a compensator which may be a zener diode positioned downstream from a series of light emitting diodes. The compensating software monitors the current drop across a series of light emitting diodes and initially assigns a current analysis value based upon the frequency and/or type of light emitting diode utilized. The compensating software then compares a signal representative of the current drop to the current analysis value to increase and/or decrease current exposed to the light emitting diodes to maximize illumination from the light sources.

9 Claims, 14 Drawing Sheets

U.S. PATENT DOCUMENTS 4,966,862 A 10/1990 Edmond ..... 438/27
4,990,970 A 2/1991 Fuller ..... 257/98
5,027,168 A 6/1991 Edmond ..... 257/103
5,045,767 A 9/1991 Wakatake ..... 318/696
5,050,055 A 9/1991 Lindsay et al. ..... 362/293
5,093,768 A 3/1992 Ohe ..... 362/241
5,097,397 A 3/1992 Stanuch et al. ..... 362/493
5,097,612 A 3/1992 Williams ..... 40/591
5,101,326 A 3/1992 Roney ..... 362/61
5,122,943 A 6/1992 Pugh ..... 362/256
5,136,287 A 8/1992 Borenstein ..... 340/925
5,187,547 A 2/1993 Niina et al. ..... 257/77
5,198,746 A * 3/1993 Gyugyi et al. ..... 323/207
5,220,235 A 6/1993 Wakimizu et al. ..... 313/25
5,224,773 A 7/1993 Arimura ..... 362/227
5,233,204 A 8/1993 Fletcher et al. ..... 257/13
5,235,498 A 8/1993 Van Dulmen et al. ..... 362/549
5,283,425 A 2/1994 Imamura ..... 250/208.1
5,302,965 A 4/1994 Belcher et al. ..... 345/31
5,313,187 A 5/1994 Choi et al. ..... 340/331
5,321,593 A 6/1994 Moates ..... 362/251
5,350,977 A * 9/1994 Hamamoto et al. ..... 315/291
5,357,123 A 10/1994 Sugawara ..... 257/88
5,357,409 A 10/1994 Glatt ..... 362/105
5,359,255 A 10/1994 Kawai et al. ..... 313/17
5,361,190 A 11/1994 Roberts et al. ..... 362/61
5,362,971 A 11/1994 McMahon et al. ..... 250/577
5,403,916 A 4/1995 Watanabe et al. ..... 438/26
5,406,095 A 4/1995 Koyama et al. ..... 40/550
5,410,328 A 4/1995 Yoksza et al. ..... 345/82
5,419,065 A 5/1995 Lin ..... 257/88
5,420,444 A 5/1995 Sawase et al. ..... 257/99
5,422,623 A 6/1995 Bader et al. ..... 340/331
5,450,301 A 9/1995 Waltz et al. ..... 362/231
5,475,241 A 12/1995 Harrah et al. ..... 257/99
5,482,896 A 1/1996 Tang ..... 438/28
5,490,049 A 2/1996 Montalan et al. ..... 362/240
5,491,350 A 2/1996 Unno et al. ..... 257/99
5,498,883 A 3/1996 Lebby et al. ..... 257/95
5,514,627 A 5/1996 Lowery et al. ..... 438/26
5,516,727 A 5/1996 Broom ..... 438/26
5,519,720 A 5/1996 Hirano et al. ..... 372/36
5,526,237 A 6/1996 Davenport et al. ..... 362/551
5,528,474 A 6/1996 Roney et al. ..... 362/249
5,567,036 A 10/1996 Theobald et al. ..... 362/485
5,569,939 A 10/1996 Choi ..... 257/94
5,575,459 A 11/1996 Anderson ..... 362/240
5,580,156 A 12/1996 Suzuki et al. ..... 362/184
5,585,783 A 12/1996 Hall ..... 340/473
5,593,223 A 1/1997 Koizumi ..... 362/255
5,612,231 A 3/1997 Holm et al. ..... 438/23
5,625,201 A 4/1997 Holm et al. ..... 257/88
5,627,851 A 5/1997 Takahashi ..... 372/44
5,631,474 A 5/1997 Saitoh ..... 257/88
5,632,551 A 5/1997 Roney et al. ..... 362/249
5,634,711 A 6/1997 Kennedy et al. ..... 362/49
5,636,916 A 6/1997 Sokolowski ..... 362/477
5,656,829 A 8/1997 Sakaguchi et al. ..... 257/94
5,661,645 A 8/1997 Hochstein ..... 363/89
5,661,742 A 8/1997 Huang et al. ..... 372/46
5,674,000 A 10/1997 Kalley ..... 362/293
5,694,112 A 12/1997 VannRox et al. ..... 340/472
5,697,175 A 12/1997 Schwartz ..... 40/552
5,705,047 A 1/1998 Lee ..... 205/123
5,707,891 A 1/1998 Izumi et al. ..... 257/86
5,726,535 A 3/1998 Yan ..... 362/800
5,739,552 A 4/1998 Kimura et al. ..... 257/89
5,739,592 A 4/1998 Rigsby et al. ..... 307/9.1
5,758,947 A 6/1998 Glatt ..... 362/105
5,760,531 A 6/1998 Pederson ..... 313/25
5,785,418 A 7/1998 Hochstein ..... 362/373
5,789,768 A 8/1998 Lee et al. ..... 257/96
5,793,062 A 8/1998 Kish, Jr. et al. ..... 257/98
5,796,376 A 8/1998 Banks ..... 345/82
5,804,822 A 9/1998 Brass et al. ..... 250/302
5,805,081 A 9/1998 Fikacek ..... 340/908
5,806,965 A 9/1998 Deese ..... 362/249
5,838,024 A 11/1998 Masuda et al. ..... 257/98
5,838,247 A 11/1998 Bladowski ..... 340/815.45
5,848,837 A 12/1998 Gustafson ..... 362/235
5,898,381 A 4/1999 Gartner et al. ..... 340/815.65
5,900,850 A 5/1999 Bailey et al. ..... 345/55
5,929,788 A 7/1999 Vukosic ..... 340/908.1
5,931,562 A 8/1999 Arato ..... 362/184
5,932,860 A 8/1999 Plesko ..... 235/454
5,934,694 A 8/1999 Schugt et al. ..... 280/33.991
5,975,714 A 11/1999 Vetorino et al. ..... 362/192
5,990,802 A 11/1999 Maskeny ..... 340/815.45
6,009,650 A 1/2000 Lamparter ..... 40/572
6,018,899 A 2/2000 Hanitz ..... 40/473
6,028,694 A 2/2000 Schmidt ..... 359/264
6,095,661 A 8/2000 Lebens et al. ..... 362/184
6,102,696 A 8/2000 Osterwalder et al. ..... 433/29
6,118,388 A 9/2000 Morrison ..... 340/908
6,159,005 A 12/2000 Herold et al. ..... 433/29
6,166,496 A * 12/2000 Lys et al. ..... 315/316
6,177,678 B1 1/2001 Brass et al. ..... 250/461.1
6,183,100 B1 2/2001 Suckow et al. ..... 362/35
6,285,140 B1 * 9/2001 Ruxton ..... 315/312
6,498,440 B2 * 12/2002 Stam et al. ..... 315/291

FOREIGN PATENT DOCUMENTS

EP 0887 783 A2 12/1998
EP 0 890 894 A1 1/1999
FR 2 658 024 2/1990
FR 2 680 861 9/1991
FR 2 707 222 7/1993
FR 2 800 500 10/2000
GB 2 069 257 A 8/1981
GB 2 175 428 A 11/1986
GB 2 240 650 A 8/1991
GB 2 272 791 A 5/1994
GB 2 292 450 A 2/1996
GB 2 311 401 A 9/1997
GB 2 330 679 A 10/1998
WO 99/35634 7/1999

* cited by examiner

LED COMPENSATION CIRCUIT

RELATED CASES

This application corresponds and claims priority to U.S. Provisional Patent Application No. 60/209,766 entitled Duty Cycle Compensation Circuit DC3 filed Jun. 6, 2000 which is incorporated herein by reference in its entirety.

BACKGROUND OF THE INVENTION

Light bars or emergency lights of the type used on emergency vehicles such as fire trucks, police cars, and ambulances, utilize warning signal lights to produce a variety of light signals. These light signals involve the use of various colors and patterns. In the past these warning signal lights have utilized incandescent and halogen light sources having reflective back support members and colored filters.

Many problems exist with the known methods for producing warning light signals. One particular problem with known light sources is their reliance on mechanical components to revolve or oscillate the lamps to produce the desired light signal. Additionally, these components increase the size of the light bar or emergency lights which may adversely affect the vehicles aerodynamic characteristics. Moreover, there is an increased likelihood that a breakdown of the light bar or light source will occur requiring the repair or replacement of the defective component. Finally, the known light bars and light sources require a relatively large amount of electrical current during operation. The demands upon the electrical power system for a vehicle may therefore exceed available electrical resources reducing optimization of performance.

In the past the most common light sources being used in light bars or emergency lights were halogen lamps or gaseous discharge xenon lamps. These lamps emanate large amounts of heat which is difficult to dissipate from a sealed light enclosure or emergency light and which may damage the electronic circuitry contained therein. In addition, these lamps consume large amounts of current requiring a large power supply or large battery or electrical source which may be especially problematic for use with a vehicle. These lamps also generate substantial electromagnetic emissions which may interfere with radio communications for a vehicle. Finally, these lamps, which are not rugged, have relatively short life cycles necessitating frequent replacement.

Another problem with the known warning signal lights is the use of filters to produce a desired color. Filtering techniques produce more heat that must be dissipated. Moreover, changing the color of a light source requires the physical removal of the filter from the light source or emergency light and the insertion of a new filter. Furthermore, filters fade or flake over time rendering the filters unable to consistently produce a desired color for observation in an emergency situation.

These problems associated with traditional signaling lamps are exacerbated by the fact that creating multiple light signals requires multiple signaling lamps. Further, there is little flexibility in modifying the light signal created by a lamp. For example, changing a stationary lamp into one that rotates or oscillates would require a substantial modification to the light bar which may not be physically or economically possible.

To attempt to solve the above identified and other problems Light Emitting Diodes (LED's) are being used to replace the gaseous discharge or incandescent lamps as used as automotive warning signal light sources.

LED's are particularly useful in the production of true light color output because LED's may be manufactured to provide a specific light wavelength at any desired frequency associated with a desired color. LED's are therefore capable of producing intense coloring associated with emergency vehicles, i.e., red, blue, amber, green, and clear or white.

Another problem with the known warning signal lights is the absence of flexibility for the provision of variable intensity for the light sources to increase the number of available distinct and independent visual light effects. In certain situations it may be desirable to provide a variable intensity for a light signal or a modulated intensity for a light signal to provide a unique light effect to facilitate observation by an individual. In addition, the provision of a variable or modulated intensity for a light signal may further enhance the ability to provide a unique desired light effect for observation by an individual.

No warning lights are known which are flexible and which utilize a variable light intensity to modify a standard lighting effect. The warning lights as known are generally limited to a flashing light signal. Alternatively, other warning signal lights may provide a sequential illumination of light sources. No warning or utility light signals are known which simultaneously provide for modulated and/or variable power intensity for a known type of light signal to create a unique and desirable type of lighting effect.

No warning signal lights are known which provide an irregular or random light intensity to a warning signal light to provide a desired lighting effect. Also, no warning light signals are known which provide a regular pattern of variable or modulated light intensity for a warning signal light to provide a desired type of lighting effect. Further, no warning light signals are known which combine a desired type of light effect with either irregular variable light intensity or regular modulated light intensity to provide a unique and desired combination lighting effect.

It has also not been known to provide alternative colored LED light sources which may be electrically controlled for the provision of any desired pattern of light signal such as flashing, pulsating, oscillating, modulating, variable, rotational, alternating, strobe, and/or combination light effects. In this regard, a need exists to provide a spatially and electrically efficient LED light source for use on an emergency or utility vehicle which provides the appearance of rotation or other types of light signals without the necessity of a mechanical devices. In addition, a need exists to provide a spatially and electrically efficient LED light source for use on an emergency vehicle which provides a flashing, modulated, variable, oscillating, rotational, alternating, and/or strobe light effects without the necessity of mechanical devices.

In view of the above, there is a need for a warning signal light that:

(1) Is capable of producing multiple light signals;
(2) Produces the appearance of a revolving or oscillating light signal without relying upon mechanical components;
(3) Generates little heat;
(4) Uses substantially less electrical current;
(5) Produces significantly reduced amounts of electromagnetic emissions;
(6) Is rugged and has a long life cycle;
(7) Produces a truer light output color without the use of filters;
(8) Is positionable at a variety of locations about an emergency vehicle; and (9) Provides variable power intensity to the light source without adversely affecting the vehicle operator's ability to observe objects while seated within the interior of the vehicle.

In the past, flashing light signals emanating from light bars have been used to signal the presence of an emergency situation necessitating caution. A need exists to provide alternative colored LED light signals which may be electrically controlled for the provision of any desired pattern of light signal such as flashing, alternating, pulsating, oscillating, modulating, variable, rotational, and/or strobe light effects without the necessity of spatially inefficient and bulky mechanical devices. In that regard, a need exists to provide a spatially and electrically efficient LED light source for use on an emergency vehicle which provides any of the above-identified types of warning light signals without the necessity of mechanical devices.

Another problem encountered during use of LED light sources is the optimization of the efficiency of the LED light sources for the provision of maximized illumination. Insufficient electrical current provided to the LED's results in non-optimized illumination, and excess current may burn the LED's out, damage the driving circuitry, and/or reduce the operational life of the LED's. In the past manufacturing discrepancies have occurred between different lots of LED's where the different lots of LED's have slightly different electrical properties. The maximization of the illumination for individual or groups of LED's is therefore problematic due to the inclusion of the LED's within standardized electrical circuitry. Customization of each circuit containing individual LED's is cost prohibitive. In addition, LED's having different frequencies or colors may also have different electrical properties reducing optimization within standardized circuitry. Further, individual LED's may degrade at different rates. A need exists to initially test or screen one or more LED's for initial conformance to known electrical specifications for inclusion within standardized circuitry. A need also exists to periodically monitor the voltage and/or current drop across one or more individual LED's to adjust the duty cycle of the LED's during use, for optimization of illumination during the life span of the LED's.

GENERAL DESCRIPTION OF THE INVENTION

According to the invention, there is provided a light emitting diode (LED) warning signal light which may be depicted in several embodiments. In general, the warning signal light may be formed of a single LED light source, a single row or an array of light emitting diode light sources configured on a light support and in electrical communication with a controller, compensator, and a power supply, battery, or other electrical source. The warning signal light may provide various light signals, colored light signals, or combination light signals for use by a vehicle. These light signals may include a strobe light, a pulsating light, a revolving light, a flashing light, a modulated or variable intensity light, an oscillating light, an alternating light, and/or any combination thereof. Additionally, the warning signal light may be capable of displaying symbols, characters, or arrows. Simulated or actual rotating and oscillating light signals may be produced by sequentially illuminating columns of LED's on a stationary or rotatable light support in combination with the provision of variable power intensity from the controller. Alternative colored LED light sources may also be electrically controlled for the provision of any desired pattern of warning light signals as previously identified.

A plurality of light sources each containing an array or singular LED may be in electrical communication with a power supply and a controller to selectively illuminate the LED's to provide for the appearance of a revolving, modulating, variable, strobe, oscillating, alternating, pulsating, and/or flashing light source or any combinations thereof. The controller is preferably in electrical communication with the power supply and the LED's to modulate the power intensity for the LED light sources for variable illumination of the LED light sources.

A principal advantage of the present invention is the optimization of performance of a warning signal light which is capable of producing several different types of light signals or combinations of light signals.

Another principal advantage of the present invention is to be rugged and have a relatively longer life cycle than traditional warning signal lights.

Still another principal advantage of the present invention is to produce a truer or pure light output color without the use of filters.

Still another principal advantage of the present invention is to allow the user to adjust the color of the light signal without having to make a physical adjustment from a multi-colored panel.

Still another advantage of the present invention is that the light signal produced may be easily customized by the user via a controller or microprocessor.

Still another principal advantage of the present invention is the provision of an LED light source which is formed of a relatively simple and inexpensive design, construction, and operation and which fulfills the intended purpose without fear of failure or injury to persons and/or damage to property.

Still another principal advantage of the present invention is the provision of an LED light source for creation of bright bursts of intense white or colored light to enhance the visibility and safety of a vehicle in an emergency signaling situation.

Still another principal advantage of the present invention is the provision of an LED light source which produces brilliant lighting in any of the colors associated with an emergency vehicle light signal such as red, blue, amber, green, and/or white.

Still another principal advantage of the present invention is the provision of an LED light source which has an extended life cycle and continues to operate at maximum efficiency throughout its life cycle.

Still another principal advantage of the present invention is the provision of an LED light source which draws less current and/or has a reduced power requirement from a power source for a vehicle.

Still another principal advantage of the present invention is the provision of an LED light source which functions under cooler operating temperatures and conditions thereby minimizing the exposure of heat to adjacent component parts which, in turn, reduces damage caused by excessive heat.

Still another principal advantage of the present invention is the provision of an LED light source having simplified compensating electronic circuitry for use as a component within standardized electrical circuitry of an electrical signaling system having known electrical characteristics.

Still another principal advantage of the present invention is the provision of a warning signal light which includes LED technology and which is operated by a controller to provide any desired type or color of light signal including but not limited to rotational, pulsating, oscillating, strobe, flashing, alternating, variable, and/or modulated light signals without the necessity for mechanical devices.

Still another principal advantage of the present invention is the provision of a warning signal light which is capable of simultaneously producing several different types of light signals.

Still another principal advantage of the present invention is the provision of a warning signal light which includes a controller having compensating software which may sense and adjust the current exposed to an LED module to modify the duty cycle for illuminated LED's to compensate for a current or voltage drop.

Still another principal advantage of the present invention is the provision of an LED module which includes a compensator for initial adjustment of the electrical characteristics of the LED module for optimization within a light emitting diode signaling system.

Still another principal advantage of the present invention is the provision of an LED light source which is flexible and which may be connected to a modulated power source to provide variable power intensity for the light source which in turn is used to create any desired type, pattern, or combination of light effects.

Still another principal advantage of the present invention is the provision of a plurality of light emitting diodes (LED's), integral to a circuit board or LED mounting surface, where the LED's may be aligned in a single row or in vertical columns and horizontal rows.

Still another advantage of the present the invention is the provision of an LED support member supporting an array of colored LED's and a controller capable of selectively illuminating the LED's of the same color to produce a single or mixed colored light signal.

Still another advantage of the invention is the provision of a light emitting diode support member having LED's disposed about at least two sides and a controller capable of producing light signals on each side which are independent of each other.

Still another advantage of the invention is the provision of an LED support member which may be easily connectable to an emergency vehicle, including but not limited to automobiles, ambulances, trucks, motorcycles, snowmobiles, and/or any other type of vehicle in which warning signal or emergency lights are utilized.

Still another advantage of the present invention is the provision of a warning signal light having a controller in electrical communication with a plurality of light supports or single light sources for the provision of a modulated power intensity to the light sources.

Still another advantage of the present invention is the provision of an LED light source which may include a substantially conical shaped reflector or culminator positioned adjacent to the light source.

Still another advantage of the present invention is the provision of a substantially conical reflector which may include concave and/or convex reflective surfaces to assist in the reflection of light emitted from an LED light source.

Still another advantage of the present invention is the provision of an LED light support having a longitudinal dimension formed of one or more LED modules which provide a desired type of warning light signal.

Still another advantage of the present invention is the provision of an LED light support including a circuit board or LED mounting surface having one or more heat sink wells each adapted to receive an individual LED as positioned within each of the heat sink wells.

Still another advantage of the present invention is the provision of an LED light support having one or more reflectors or elongate mirrors disposed in a frame to reflect light emitted from the LED light sources is a desired direction.

Still another advantage of the present invention is the provision of an LED light support having a culminator reflector which may be formed of one or more substantially conical reflector cups which are utilized to reflect light emitted from the light sources in a direction desired by an individual.

DETAILED DESCRIPTION OF THE PREFERRED EMBODIMENTS

Figure 1:
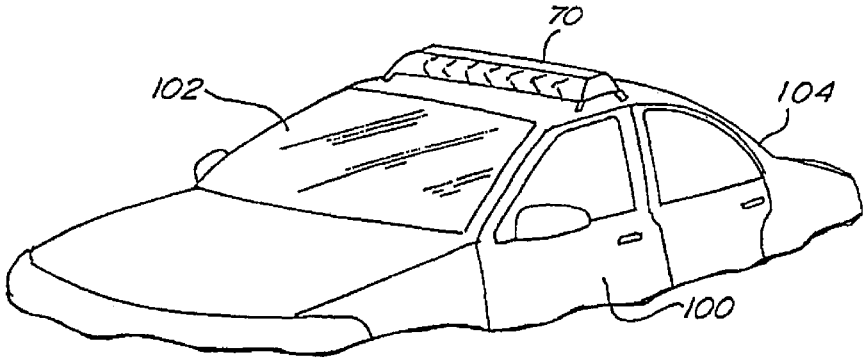
FIG. 1 is a partial perspective view of an emergency vehicle equipped with a light bar containing warning signal lights according to an embodiment of the invention.
Figure 2:
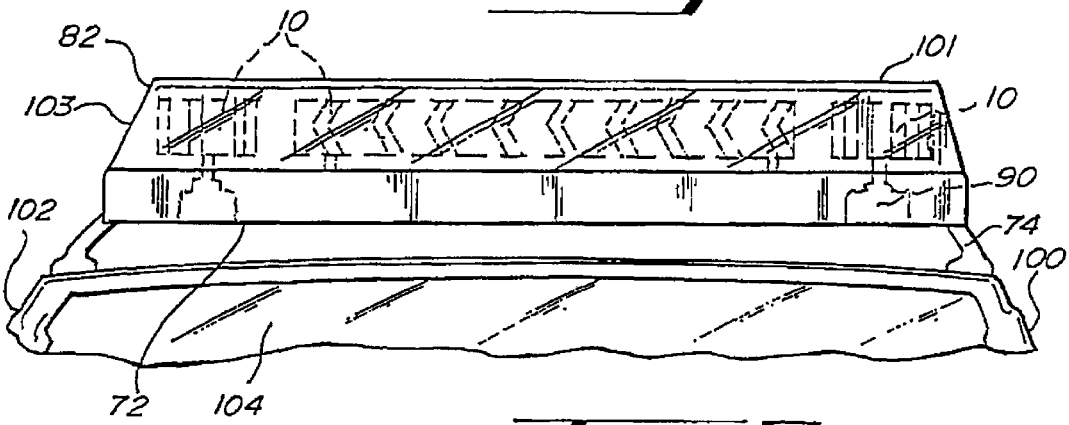
FIG. 2 is a partial front elevation view of an emergency vehicle equipped with a light bar containing warning signal lights referring to an embodiment of the invention.
Figure 3:
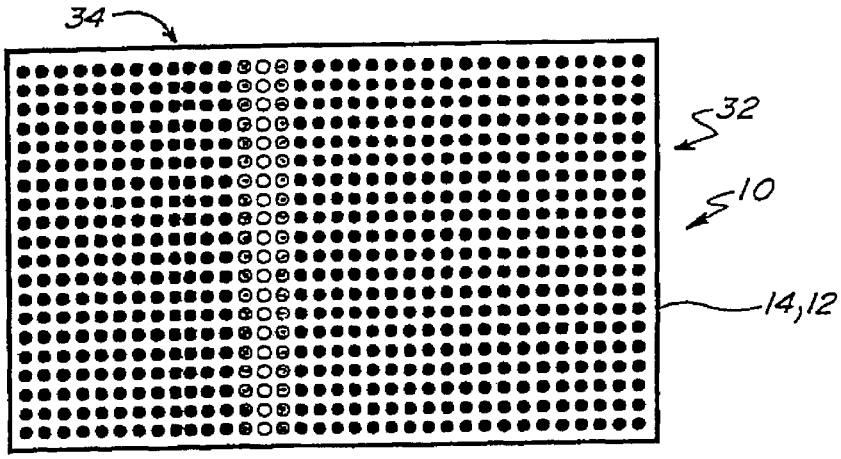
FIG. 3 is a perspective view of a warning light signal according to an embodiment of the invention.

A warning signal light according to the principles of the invention is indicated generally herein as numeral 10. FIGS. 1 and 2 depict light bar 70 mounted to an emergency vehicle 104. Light bar 70 includes base 72, mounting means 74, cover 82, and warning signal lights 10. Also included in light bar 70 may be gyrators 90 used to impart motion to warning signal lights 10.

Figure 4:
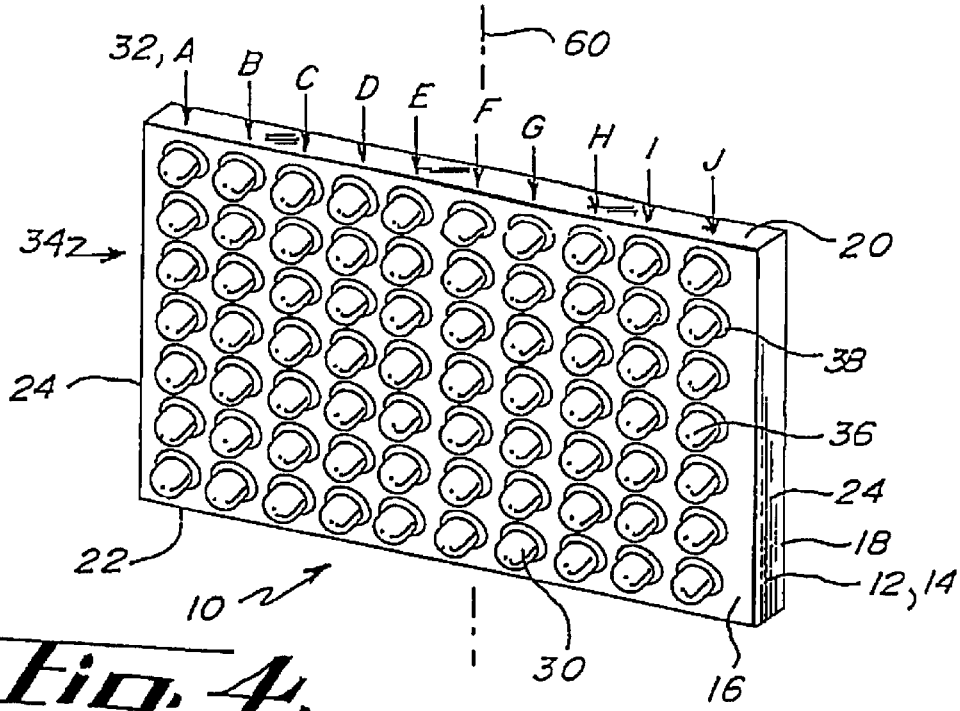
FIG. 4 is a perspective view of a warning light signal according to an embodiment of the invention.

Referring to FIG. 4, warning signal light 10 comprises light support 12, light sources 30, controller 50 (shown in FIG. 6), and connecting portion 40 for attaching the warning signal light 10 to light bar 70 or gyrator 90. The warning signal light 10 operates to create a warning signal for use by an emergency vehicle 104 by selectively activating light sources 30 using controller 50. Alternatively, warning signal light 10 may be formed of a solitary LED light source 30.

Figure 15:
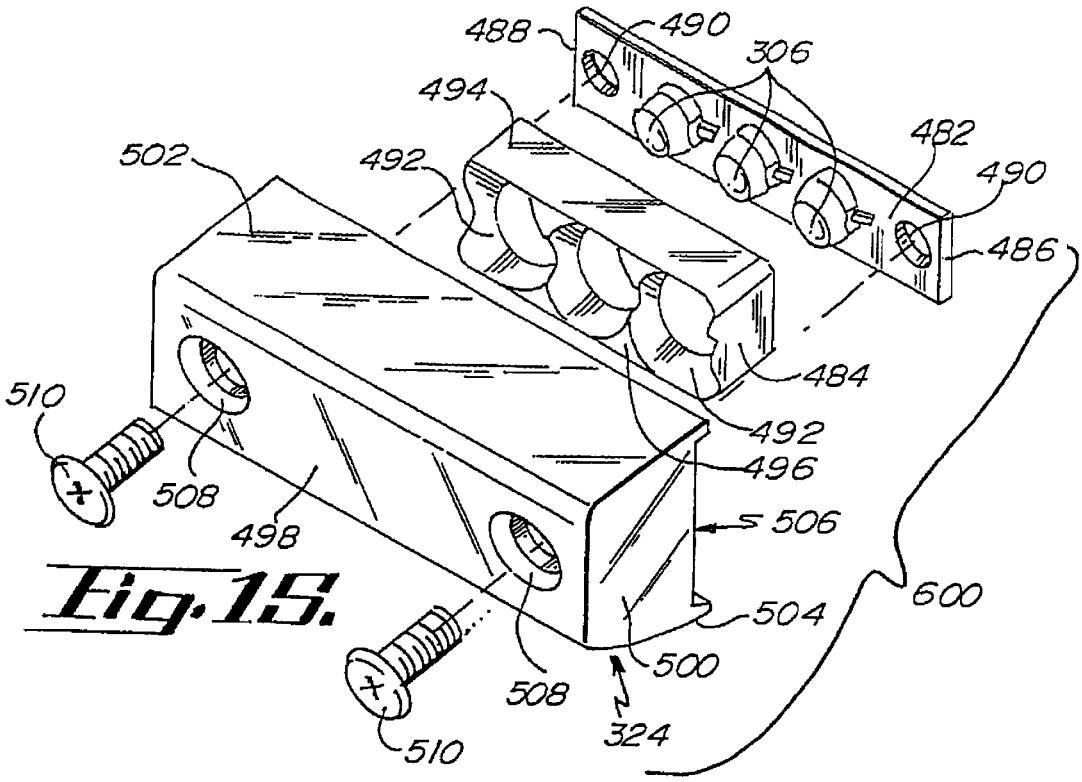
FIG. 15 is an exploded isometric view of an alternative cullminator assembly and replacement LED light module.

Light sources 30 are preferably light emitting diodes (LED's) and are generally arranged in modules formed of groups of LED's as shown in FIG. 15. Each of the light emitting diodes (LED's) may have shoulder portion 38 adjacent LED support 12 and dome 36. LED's 30 are situated to be in electric communication with controller 50 and a power supply, a battery, or power source. The use of light emitting diodes (LED's) to replace traditional halogen, incandescent, or gaseous discharge xenon lamps reduces heat generation, current draw, and electromagnetic emissions, while increasing lamp life and producing a more true output light color.

The controller 50 is used to selectively activate one or more individual LED's 30, to illuminate any number of a plurality of visually distinct types of warning light signals at any moment; to illuminate more than one of a plurality of visually distinct types of warning light signals simultaneously at any moment; to illuminate one of a plurality of combinations or patterns of visually distinct warning light signals at any moment, or over any desired period of time, or to illuminate more than one of a plurality of combinations or patterns of visually distinct warning light signals over any desired period of time. The plurality of visually distinct warning light signals may include, but are not necessarily limited to, a strobe light signal, a pulsating light signal, an alternating light, a modulated light signal, a variable light signal, a flashing light signal, the illusion of a rotating or an oscillating light signal, a reverse character message, or images such as arrows. It should be noted that the controller 50 may also incorporate into any selected warning light signal variable or modulated power intensity to facilitate the provision of a desired unique lighting effect. For example, the controller 50 may illuminate one or more LED light sources 30 to establish a single warning light signal at a given moment. Alternatively, the controller 50 may illuminate one or more light emitting diode light sources 30 to provide two or more warning light signals at any given moment. Further, the controller 50 may simultaneously, consecutively, or alternatively, illuminate one or more LED light sources 30 to establish any desired combination or pattern of illuminated visually distinct warning light signals at any given moment or over a desired period of time. The combination and/or pattern of visually distinct warning light signals may be random or may be cycled as desired by an individual. The illumination of one or more patterns or combinations of warning light signals facilitates the continued observation by an individual. Occasionally, the concentration or attention of an individual is diminished when exposed to a repetitive or to a monotonous light signal. The desired purpose for illumination of a warning light signal is thereby reduced. The provision of a pattern, combination, and/or random illumination of visually distinct warning light signal preferably maximizes the concentration or attention to be received from an individual observing a warning light signal. The purpose of the warning light signal is thereby promoted.

Figure 6A:
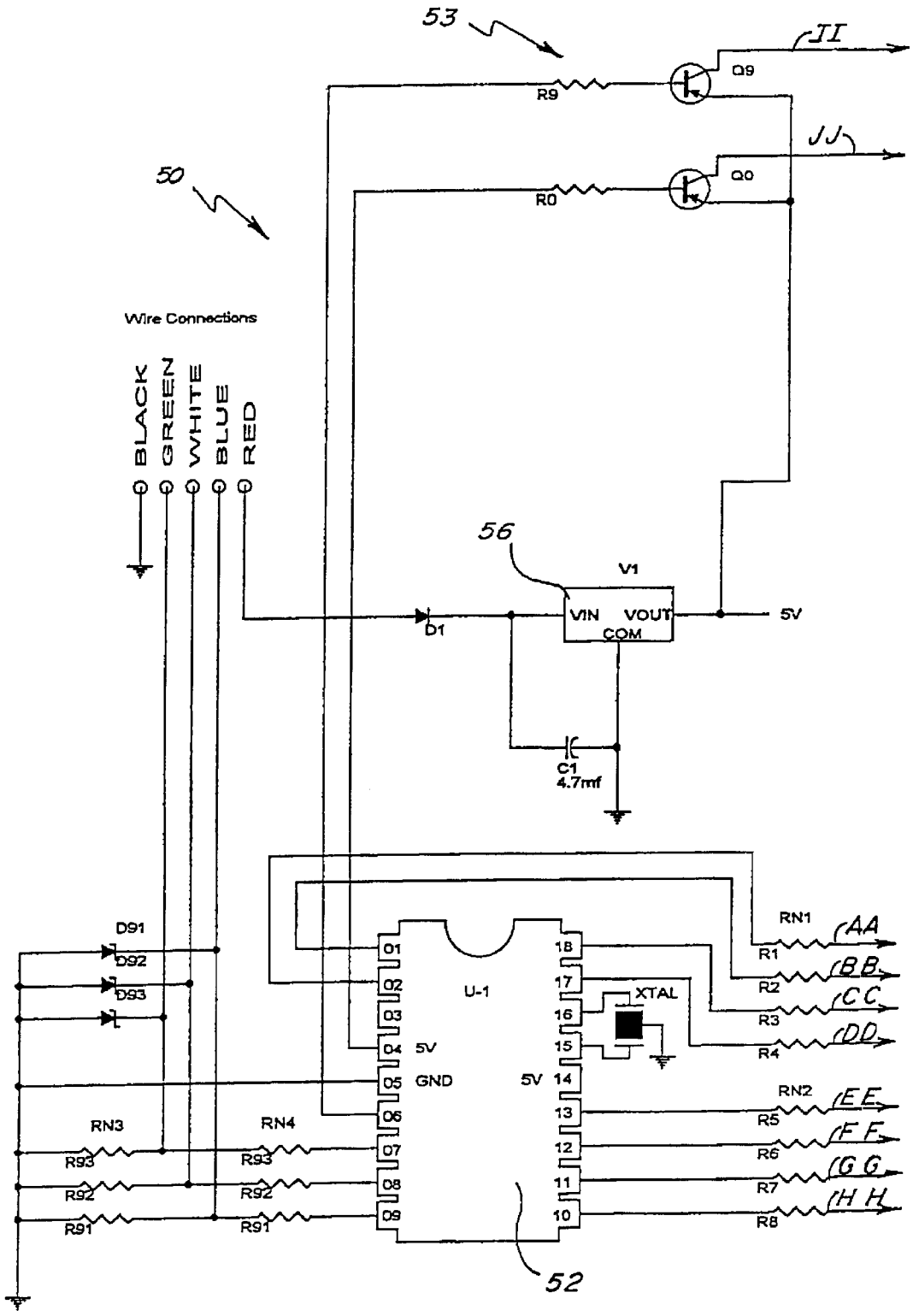
FIGS. 6A, 6B, and 6C are schematic diagrams of the controller circuitry in accordance with an embodiment of the invention.
Figure 6B:
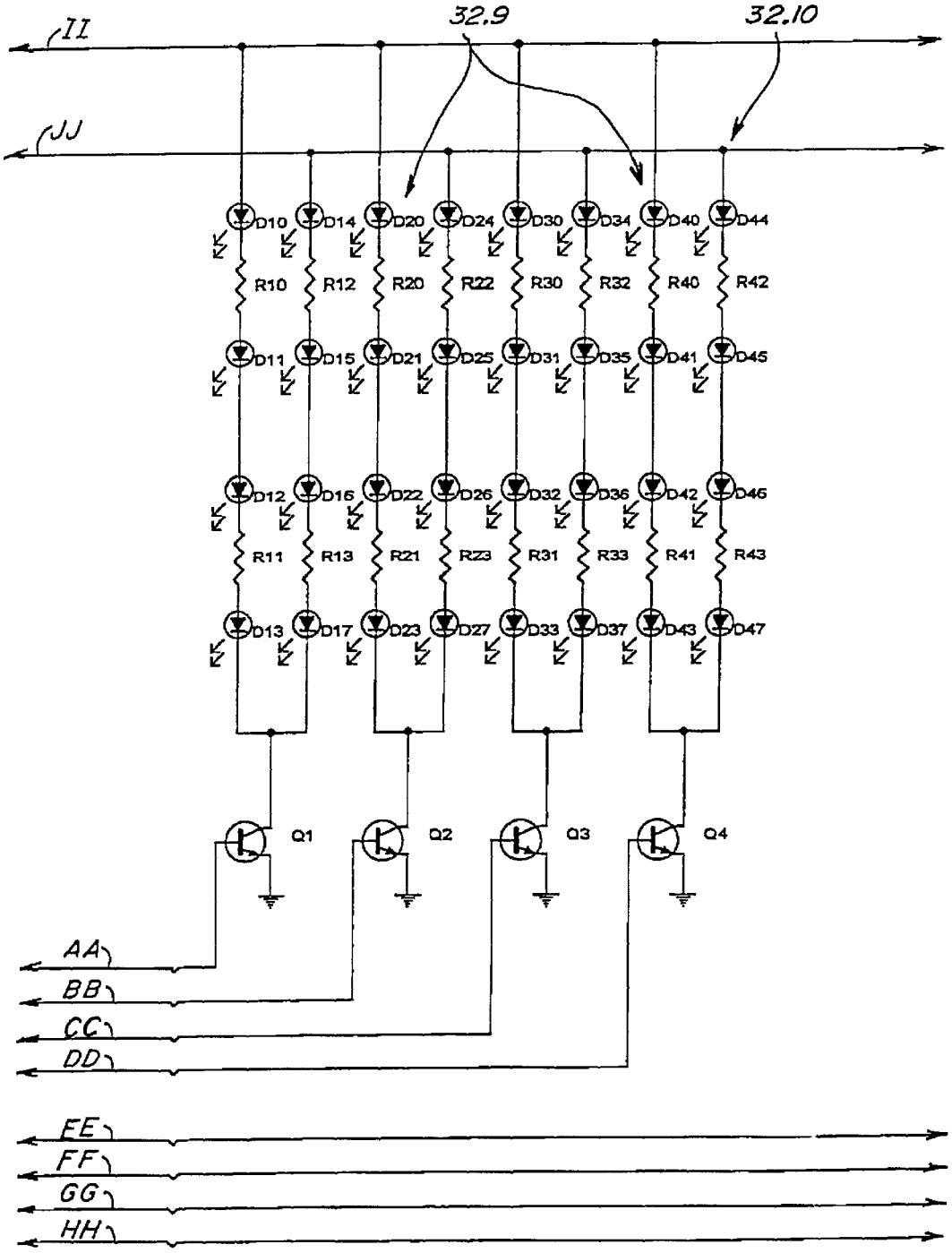
Figure 6C:
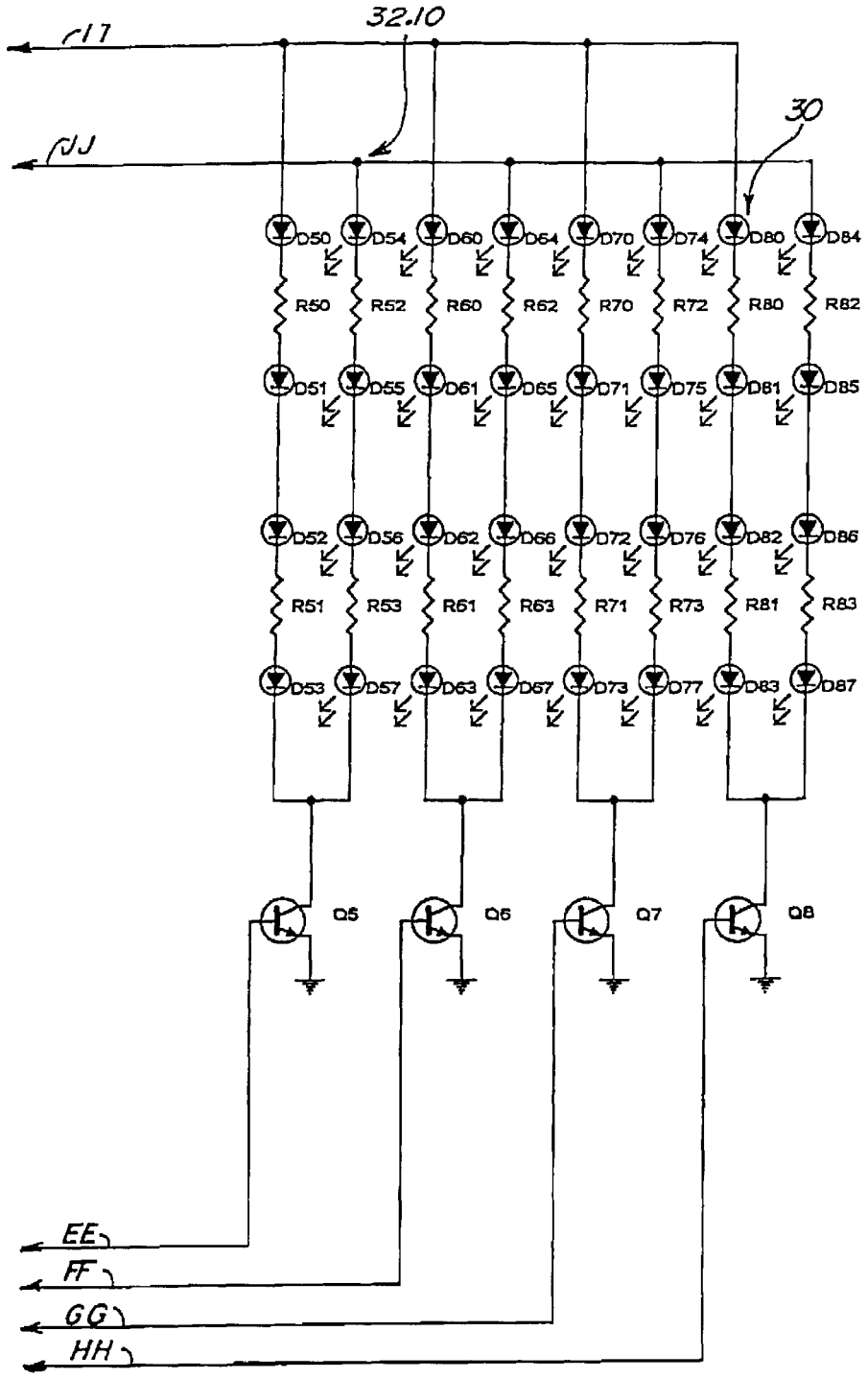

FIGS. 6A, 6B, and 6C show an embodiment of controller 50 capable of selectively activating columns 32, rows 34 or individual LED's 30. Controller 50 generally comprises microprocessor 52 and circuitry 53 and is preferably contained within, attached to, or an element of, LED support 12. It is envisioned that controller 50 may be programmed by an external controller 55 and powered through cable R.

In one embodiment, controller 50 generally comprises circuit board 54 or LED mounting surface having microprocessor 52 attached to a low voltage power supply, battery, or electrical source 56. Microprocessor 52 is configured through circuitry 53 to selectively activate columns 32 of LED's 30. Transistors Q9 and Q10 are in electronic communication with microprocessor 52, power supply, battery, or electrical source 56, and their respective columns 32.9 and 32.10 of LED's 30. Columns 32 of LED's 30 are connected to transistors Q1–Q8, which are in turn connected to microprocessor 52 through resistors R1–R8. Microprocessor 52 is capable of selectively activating transistors Q1–Q8 to allow current flowing through transistors Q9 and Q-10 to activate the selected column 32 of LED's 30. This circuit is capable of producing a strobe light signal, an alternating light signal, a modulated signal, a variable light signal, a revolving light signal, a pulsating light signal, an oscillating light signal, or flashing light signal, a reverse character message, or images such as arrows.

In one embodiment, a rotating or oscillating light signal may be established by the sequential illumination of entire columns 32 of LED's 30 by turning a desired number of columns on and then sequentially illuminating one additional column 32 while turning another column 32 off. Alternatively, the rotating or oscillating warning light signal may be created by selectively activating columns 32 of LED's 30.

A second embodiment of controller 50 provides a means for activating LED's 30 individually to allow for greater flexibility in the type of warning light signal created. This embodiment of the invention is capable of displaying information in different colors or patterns. Depending on the size of the display, it may be necessary to scroll the symbols or characters across the display to accommodate for a larger visual appearance. It is envisioned that the mirror image of patterns, symbols, or characters could be displayed making a desired message easily readable by drivers viewing the signal in a rear view mirror. It is also envisioned that this embodiment of the invention could display arrows indicating a direction a vehicle is to travel or other images as shown in FIG. 2. In addition, combinations of warning signal lights, direction arrows, and other information carrying signals or images, could be displayed simultaneously by the invention.

LED support 12 is envisioned to have several embodiments. One embodiment, shown in FIG. 4, consists of a panel 14 having front 16, back 18, top 20, bottom 22 and sides 24. LED's 30 are arranged on front 16, with domes 36 extending therefrom, in columns 32 and rows 34. LED's 30 are in electric communication with controller 50 which may be contained or sealed within LED support 12 to provide protection from the elements.

Figure 5:
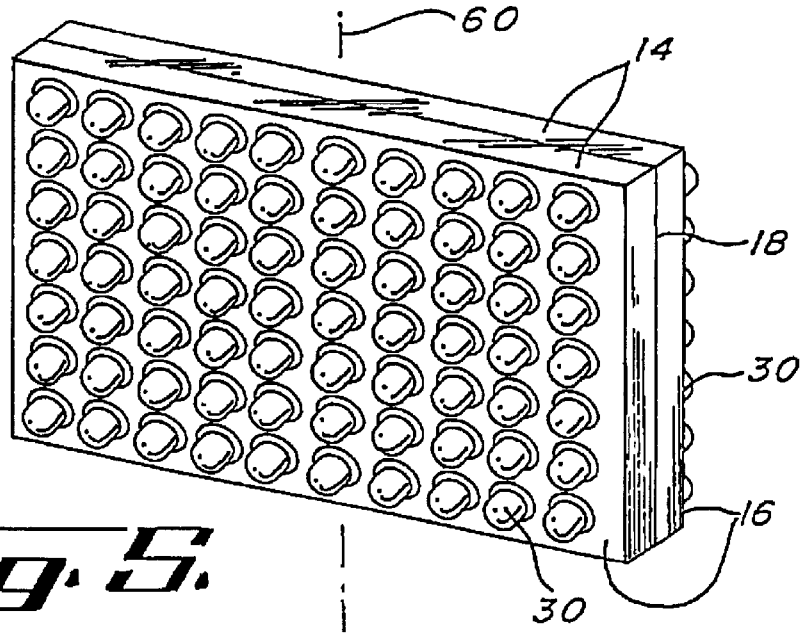
FIG. 5 is a perspective view of a warning light signal according to an embodiment of the invention.

Another embodiment of warning signal light 10 is depicted in FIG. 5. Here, the backs 18 of two panels 14 are attached together to allow for a light signal to be produced on two sides. The two panels 14 form LED support 12. Alternatively, it is envisioned that a single panel 14 having LED's arranged about front 16 and back 18 could be used as well.

It should be noted that numerous other shapes could be formed from panels 14 including those formed from combinations of flat, curved, and flexible panels.

In each of the embodiments discussed above, the array of LED's 30 may be formed of the same or differently colored LED's. Generally, each column 32 or row 34 may consist of a series of differently colored LED's. Controller 50 may be configured to select the color of the LED's to be illuminated forming the light signal. Accordingly, the user may select a blue, red, white, yellow, green, or amber color or any combination thereof to be used as the color of light signal. Alternatively, the warning signal 10 may be formed of individual LED's 30 which may be selectively illuminated.

It is also envisioned that the controller 50 may control warning signal lights 10 having multiple sides (FIG. 5) such that each side is capable of producing warning light signals or combination warning light signals that are independent and/or different from those produced upon the other sides.

Another embodiment of warning signal light 10 is depicted in FIGS. 1 and 2 as light bar 70 which extends from driver side 100 to passenger side 102 of emergency vehicle 104. Cover 82 protects light bar 70 from the elements. Each side of light bar 70 may have LED's 30 to produce or simulate warning light signals on each side of emergency vehicle 104. Furthermore, controller 50 may be used to create multiple warning light signals on each side of light bar 70. For example, controller 50 may create a simulated revolving blue light positioned at front passenger side 102 of light bar 70, oscillating white lights positioned at front driver side 100, and yellow arrows there between. Additional or alternative warning light signals may be produced out the back 18 and sides of light bar 70. It is further envisioned that light bar 70 may consist of a single light source, a group of LED's, a single row of light sources or a large array of LED's 30 across each side (not shown). This embodiment provides the largest display and, therefore, is best suited to display desired combinations of warning lights and images. It should be noted that the identified types of warning light signals, combinations and/or patterns of warning light signals, may also be reproduced through the illumination of a single row of LED light sources 30.

It should be further noted that the warning signal light 10 may be used with an automobile, motorcycle, snowmobile, personal water craft, boat, truck, fire vehicle, helicopter, and/or any other type of vehicle receptive to the use of warning signal lights 10. It should be further noted that LED support 12 or panel 14 may be mounted to the interior top dashboard of a vehicle proximate to the front windshield 106 or to the interior top rear dashboard proximate to the rear windshield 106 of a vehicle.

Mounting of a light support 12 or panel 14 to either the front or rear dashboards may minimize the necessity for inclusion of angular offsets 108 for the light sources 30 relative to the light support 12. Angular offsets, may be provided to adjust upwardly or downwardly the primary angle of illumination for a light source along a desired line of sight. For instance, if a light support were to be mounted to the interior of a windshield having an angle of incidence, then angular offsets may be used to downwardly adjust the illumination of the light sources for the provision of predominantly horizontal light. It should be further noted that LED supports 12 or panels 14 may be releasably affixed to the interior of the front or rear windshields 106 via the use of suction cups, hook-and-loop fabric material such as Velcro®, and/or any other releasable affixation mechanism at the preference of an individual. An individual may then adjust and reposition the location of the light support 12 or panels 14 anywhere within the interior of a vehicle as desired for maximization of visualization of the warning signal lights 10.

In operation, the LED replacement lamp 200 may be constructed as a replacement part for a conventional incandescent or xenon gaseous discharge lamp. The standard mounting base 270 may be sized to readily fit into the same light opening as an incandescent lamp would require, although it is apparent the electrical driving circuit for the LED replacement lamp 200 may require modifications to accommodate the LED operating principles. LED warning signal lamp 200 may be used in a variety of locations about a vehicle.

It is also envisioned that the controller 50 may control warning signal lights 200 independently of one another such that each warning signal lamp 200 is capable of producing warning light signals which are independent and/or different from those produced at another location about an emergency vehicle 104. The controller 50 may also alternate the color of the light illuminated from the warning signal lamp 200 in each area as desired by an individual. Alternatively, the controller 50 may sequentially activate warning signal lamps 200 positioned about an emergency vehicle 104 to simultaneously produce a desired color or alternating sequence of colors. It should also be noted that the controller 50 may simultaneously illuminate all LED warning signal lamps 200 to produce a flashing or strobe light which may be particularly useful in certain emergency situations.

Figure 7:
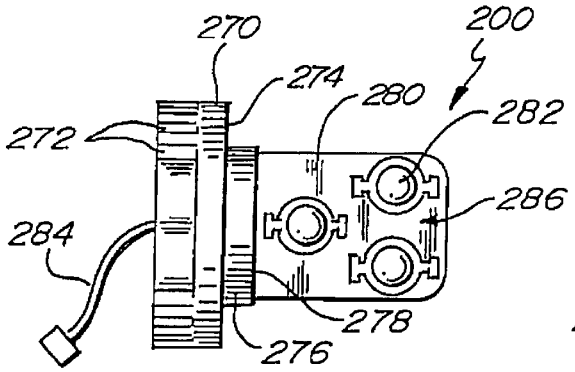
FIG. 7 is a detailed front view of a replacement LED light source.
Figure 8:
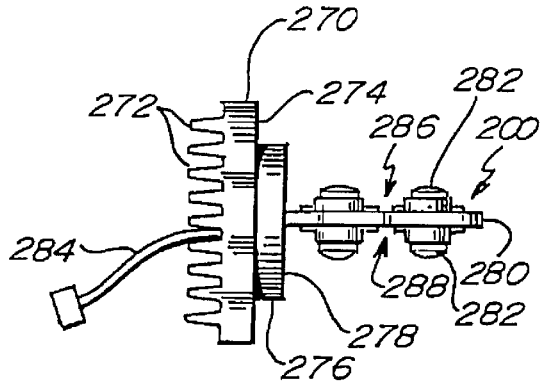
FIG. 8 is a detailed side view of a replacement LED light source.
Figure 9:
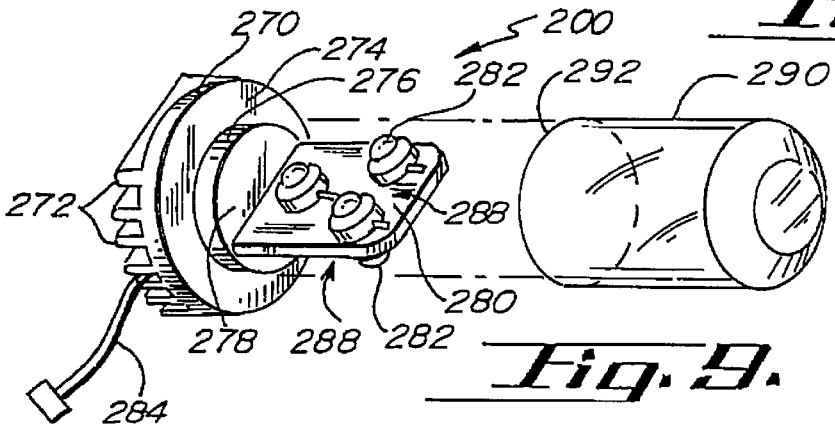
FIG. 9 is a detailed isometric view of a replacement LED light source and cover.

One embodiment of the replacement LED lamp 200 is depicted in FIGS. 7–9. In this embodiment the LED replacement lamp 200 includes a standard mounting base 270. The standard mounting base 270 also preferably includes a plurality of teeth 272. The teeth 272 are preferably adapted for mating coupling with gears integral to a motor and/or reflector 260, or rotational light fixture 246 to facilitate rotation and/or oscillation of the replacement LED lamp 200. The standard mounting base 270 also preferably includes a top surface 274 opposite to the teeth 272.

An upper cylinder portion 276 is preferably adjacent to the top surface 274. The upper cylinder portion 276 may include an upper shoulder 278. Extending upwardly from the upper shoulder 278 is preferably a circuit board, LED mounting surface, or support 280 which preferably includes one or more LED illumination sources 282. The LED illumination sources 282 may be of the same or different colors. A wire 284 is preferably in electrical communication with the LED illumination sources 282 to provide for communication and contact with the controller 50 for combination and/or individual illumination of the LED illumination sources 282. A standard plug-in connector may be integral to the wire 284 to facilitate coupling engagement to the controller 50 and/or power source for a vehicle 104. Alternatively, the replacement lamp 200 may be directly connected to the power source for a vehicle 104.

The circuit board or LED mounting surface 280 is preferably adapted to have a first side 286 and an opposite side 288. A plurality of LED illumination sources 282 may be disposed on both the first side 286 and the opposite side 288 of the replacement lamp 200.

A glass dome or protector 290 is preferably adapted for positioning over the circuit board or LED mounting surface 280 for sealing engagement to the top surface 274 of the standard mounting base 270. The glass dome 290 may be formed of transparent plastic material or a transparent or silicate glass material capable of withstanding heat stress. It should be further noted that the glass dome 290 preferably protects the circuit board or LED mounting surface 280 and the LED illumination sources 282 from contamination and from exposure to moisture during use of the replacement lamp 200. In this regard, the sealing lip 292 of the glass dome 290 preferably is securely affixed to the top surface 274 to effectuate sealing engagement therebetween. The outer diameter of the glass dome 290 is preferably about one inch which is sized to fit within the conventional opening 248 in a typical lamp fixture or reflector assembly 260.

The replacement lamp 200 depicted in FIGS. 7, 8, and 9, is also adapted to be positioned in a one inch light receptacle opening 248 which has been placed into a reflector assembly 260. Illumination of one or more individual LED illumination sources 282 as disposed on the circuit board or LED mounting surface 280 enables the replacement lamp 200 to take on the appearance of a warning signal or emergency signaling lamp.

The replacement lamp as depicted in FIGS. 7, 8, and 9, may alternatively permit the circuit board 280 to extend below the upper shoulder 278 to facilitate affixation and positioning relative to the standard mounting base 270.

The controller 50 may regulate the illumination of the LED light sources 282 individually, or in combination, to provide a desired warning lighting effect for the replacement lamp 200. Also, the controller 50 may illuminate the LED light sources 282 individually, or in combination, independently with respect to the first side 286 and the opposite side 288 to provide different warning light effects to be observed by an individual dependant upon the location of the person relative to the replacement lamp 200. The controller 50 may also simultaneously or independently regulate the power intensity to the LED illumination sources 282 to provide for a modulated or variable light intensity for observation by an individual. It should also be noted that the LED illumination sources 282 may be formed of the same or different colors.

Modulated power intensity enables the provision of various power output or patterns of illumination for creation of a plurality of visually distinct warning light signals. In these embodiments, the controller 50 illuminates selected light sources 282, and the controller 50 may also regulate and/or modulate the power supplied to the light source 282, thereby varying the intensity of the observed light. The controller 50 may modulate the power supplied to the LED warning signal lamps 10 or LED replacement lamps 200 in accordance with a sine wave pattern having a range of 0 to full intensity. At the instant of full intensity, the controller 50 may also signal or regulate a power burst for observation by an individual. The controller 50 operating to regulate and/or modulate the power intensity for the warning signal lamps 10 or LED replacement lamps 200 in conjunction with illumination and non-illumination of selected light source 282 may establish the appearance of a rotational warning light source or pulsating light source without the necessity of mechanical rotational or oscillating devices. The current draw requirements upon the electrical system of an emergency vehicle 104 is thereby significantly reduced. Spatial considerations for an emergency vehicle are also preferably optimized by elimination of mechanical, rotational and/or oscillation devices.

The controller 50 may also regulate the modulated power intensity for the provision of a unique variable intensity warning light signal. The unique variable intensity light source is not required to cycle through a zero intensity phase. It is anticipated that in this embodiment that the range of intensity will cycle from any desired level between zero power to full power. A range of power intensity may be provided between thirty percent to full power and back to thirty percent as regulated by the controller 50. It should also be further noted that an irregular pattern of variable power intensity may be utilized to create a desired type of warning light effect. In addition, the controller 50 may also sequentially illuminate adjacent columns 32 to provide a unique variable rotational, alternating, oscillating, pulsating, flashing, and/or combination variable rotational, alternating, pulsating, oscillating, or flashing visual warning light effects. A pulsating warning light signal may therefore be provided through the use of modulated power intensity to create a varying visual illumination or intensity light effect.

The use of a controller 50 to provide a modulated power intensity for a light source may be implemented in conjunction with replacement lamps 200, flexible circuit boards having LED light sources 30, paneled circuit boards or LED mounting surfaces having LED light sources 30, light bars 70 having LED light sources 30, a cylindrical, square, rectangular, or triangular-shaped circuit boards having LED light sources 30 and/or any other type or shape of LED light sources including but not limited to the embodiments described herein.

Figure 17:
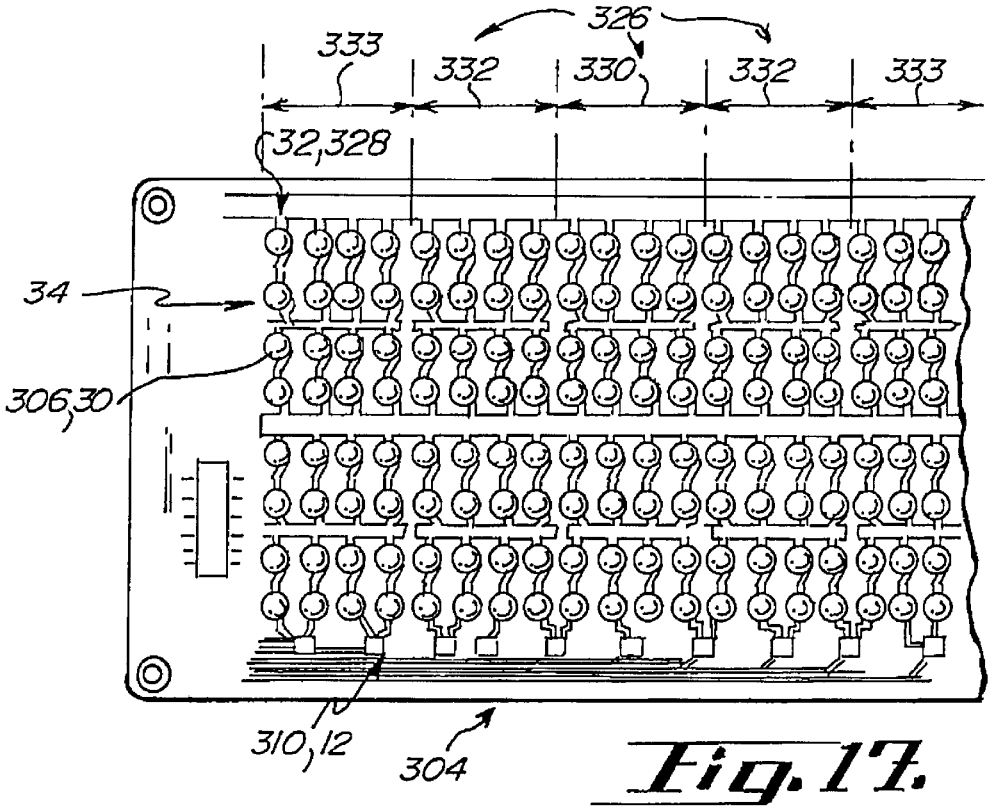
FIG. 17 is an alternative detail view of an LED light source having sectors.

Further, the controller 50 may be utilized to simultaneously provide modulated or variable light intensity to different and/or independent sections, areas, and/or sectors 326 of a light source (FIG. 17). Also, the controller 50 may be utilized to simultaneously provide modulated or variable light intensity to different and/or independent sectors, areas, and/or sections 326 of the forward facing side or rearward facing side of the light bar 70 for the provision of different warning light signals or a different warning light effects on each side. In this embodiment it is not required that the forward facing and rearward facing sides of the light bar 70 emit the identical visual patterns of illuminated light sources 30. The controller 50 may regulate and modulate the variable light intensity of any desired sector 326 of the forward facing side independently from the rearward facing side of the light bar 70. It should be further noted that an infinite variety of patterns and/or combinations of patterns of warning light signals may be provided for the forward facing side and the rearward facing side of the light bar 70.

The modulated power intensity may be regulated by the controller 50 to create a unique warning light signal within a single sector 326 or in conjunction with multiple separated or adjacent sectors 326 of light bar 70 or light support for the provision of any desired composite emergency warning light signal. All individual LED light sources 30 within a light bar 70 or light support may be simultaneously exposed to incrementally increased modulated power intensity to provide for an incremental increase in illumination. The modulation of the power intensity in conjunction with the incremental increase in illumination of all LED light sources 30 within light bar 70 or light support may provide the appearance of rotation of a warning light signal when observed by an individual. The power exposed to the individual light sources 30 may then be incrementally decreased. It should be noted that the power is not required to be regularly incrementally increased or decreased or terminated. It is anticipated that any pulsating and/or modulated variable light intensity may be provided by the controller 50 to the LED light sources 30.

It should also be noted that all individual LED light sources 30 within a light bar 70 are not required to be simultaneously and incrementally illuminated to provide for the appearance of rotation. For example, a light bar 70 or light support may be separated into one or more distinct segments 326 which are formed of one or more columns 32 of LED light sources 30. A particular segment 326 may be selected as a central illumination band which may receive the greatest exposure to the modulated or variable power intensity and, therefore, provide the brightest observable light signal. An adjacent segment 332 may be disposed on each side of the central illumination band 330 which in turn may receive modulated or variable power intensity of reduced magnitude as compared to the central illumination band 330. A pair of removed segments 333 may be adjacent and exterior to the segments 332, and in turn, may receive exposure to a modulated power source of reduced intensity as compared to segments 332. The number of desired segments may naturally vary. The controller 50 may thereby regulate a power source to provide a modulated or variable power intensity to each individual segment 330, 332, or 333 (FIG. 17) to provide for a unique warning light effect for the light bar 70 or light support.

The provision of a modulated power intensity to the light bar 70 or light support may also be coupled with, or in combination to, the sequential illumination of columns 32 as earlier described. In this situation, the warning light signal may initially be dim or off as the individual columns 32 are sequentially illuminated and extinguished for illumination of an adjacent column or columns 32. The power intensity for the illuminated column or columns 32 may simultaneously be incrementally increased for a combination unique rotational and pulsating modulated or variable warning light signal. In addition, the controller 50 may be programmed to provide the appearance of rotation pulsation and/or oscillation at the discretion of an individual.

Each individual LED light source 30 preferably provides an energy light output of between 20 and 200 or more lumens. Each light support 12 may contain a plurality of rows 34 and columns 32 of individual LED light sources 30. The light supports 12 are preferably in electrical communication with the controller 50 and power supply. Each support 12 may be controlled as part of an overall warning light signal or pattern where individual supports 12 may be illuminated to provide a desired type or combination light signal in addition to the provision of a modulated or variable power intensity for the light source 30. Each portion, section, sector, or area 326 of light bar 70 or light support may be controlled as part of an overall warning light signal or pattern where individual sections or sectors 326 may be illuminated to provide a desired type of warning light signal including but not limited to rotation and/or oscillation through the use of a modulated or variable power intensity. Alternatively, the controller 50 may provide for the random generation of light signals without the use of a preset pattern.

Referring to FIG. 17, a panel 304 of individual LED light sources 306 is depicted. The panel 304 may form the illumination element for the light bar 70 or light support 12, 302 as affixed to an emergency vehicle 300. Each panel 304 preferably contains a plurality of rows 34 and columns 32, 328 of individual LED light sources 306. The panels 304 are preferably in electrical communication with the controller 50 and power supply (now shown).

Each individual LED light source 306 is not required to receive the same level of power output from the controller 50. Different individual LED light sources 306 may receive different power output levels within a single warning light signal. Individual LED light sources 306 within panel 304 are not required to be simultaneously and incrementally illuminated to provide a desired light signal.

Figure 22:
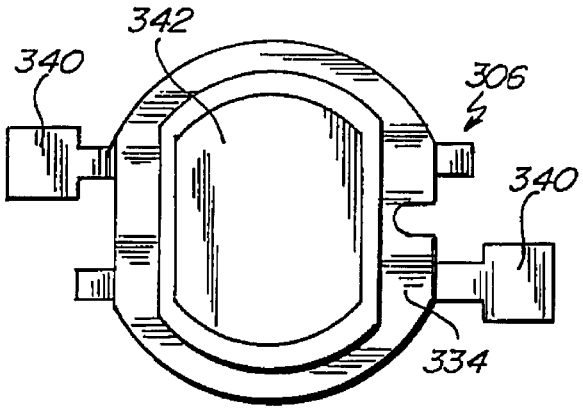
FIG. 22 is a detailed back view of an individual LED light source.
Figure 23:
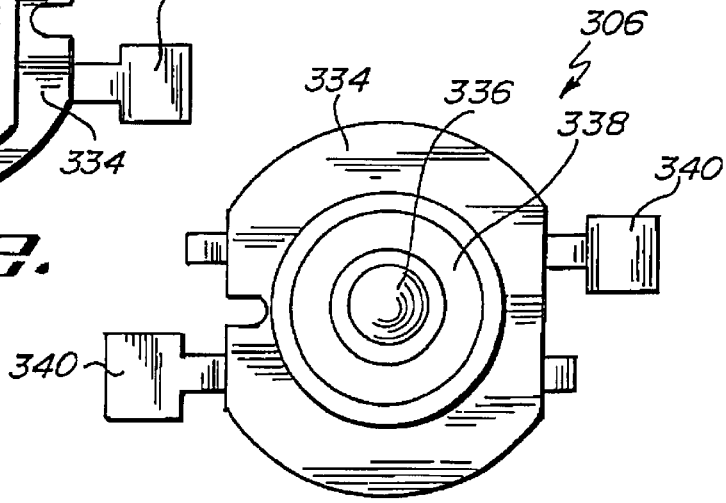
FIG. 23 is a detailed front view of an individual LED light source.
Figure 18:
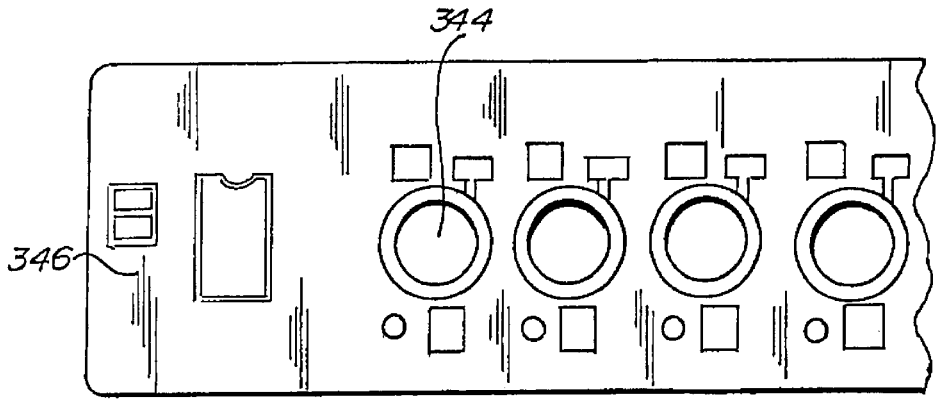
FIG. 18 is an alternative detailed view of a circuit board or LED mounting surface having heat sink wells.
Figure 20:
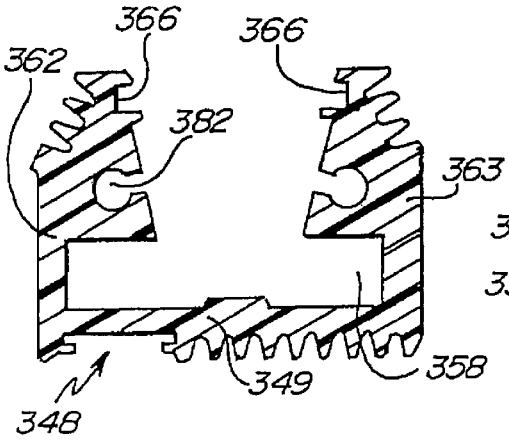
FIG. 20 is an alternative cross-sectional side view of the frame of a reflector assembly.
Figure 21:
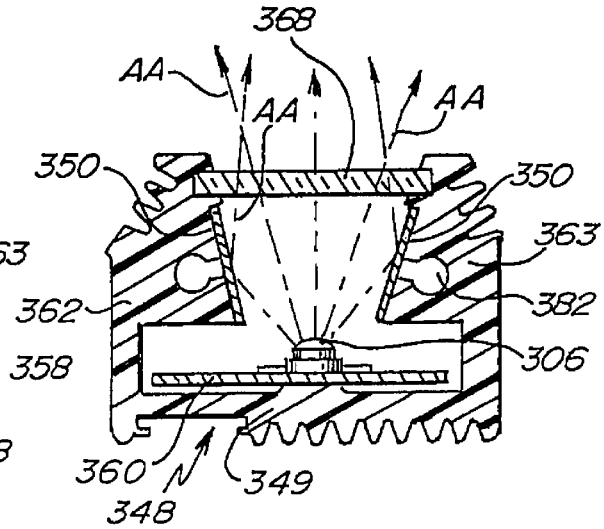
FIG. 21 is an alternative cross-sectional side view of a frame of a reflector assembly.

Referring to FIGS. 22 and 23, an individual LED light source 306 is depicted in detail. The LED light source 306 preferably include a ceramic and/or heat resistant base 334. Centrally within the ceramic and heat-resistant base 334 is positioned a light source 336. The light source 336 is preferably enclosed within a protective cover 338. Extending outwardly from the individual light source 306 are a pair of contact paddles 340 which preferably provide for the electrical contacts for illumination of the light sources 336 during use. The back of the LED light source 306 includes a slug 342. The slug 342 is designed to be positioned within circular openings 344 of a circuit board or LED mounting surface 346 (FIG. 18). The circuit board or LED mounting surface 346 preferably establishes a heat sink within an aluminum base or frame 348 as depicted in FIGS. 20 and 21. The LED light sources 306 as depicted in FIGS. 22 and 23 preferably provide for a light intensity varying between 20 and 200 lumens or higher. The positioning of the slug 342 in the circular openings 344 of the circuit board or LED mounting surface 346 also preferably establishes a heat sink. A heat sink is desirable because the individual LED light sources 306 may have a sufficient level of power output during use to develop heat. As a result, the slugs 342 are positioned within the circular opening 344 and may be fully engaged to an adhesive for affixation to an aluminum base 349 (FIGS. 20 and 21). This combination assists in the dissipation of heat during use of the individual LED light sources 306 enhancing the performance of the light support 302.

Figure 16:
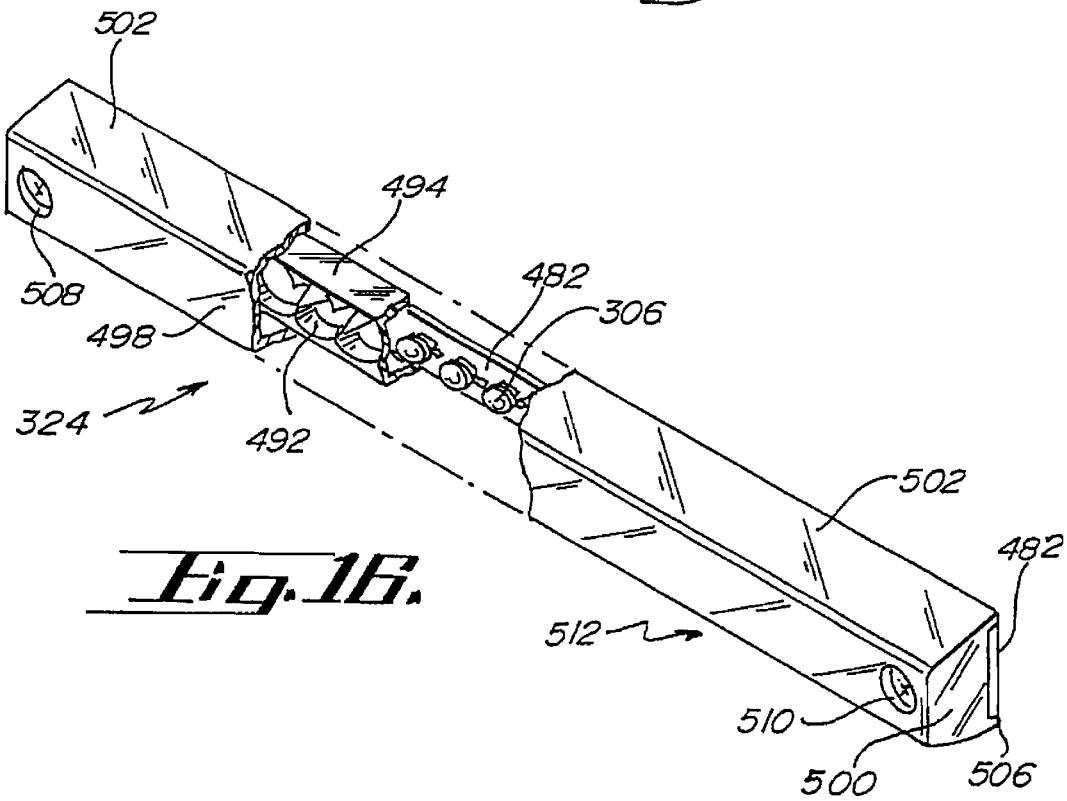
FIG. 16 is an alternative partial cut away isometric view of an alternative cullminator assembly and replacement LED light module.
Figure 19:
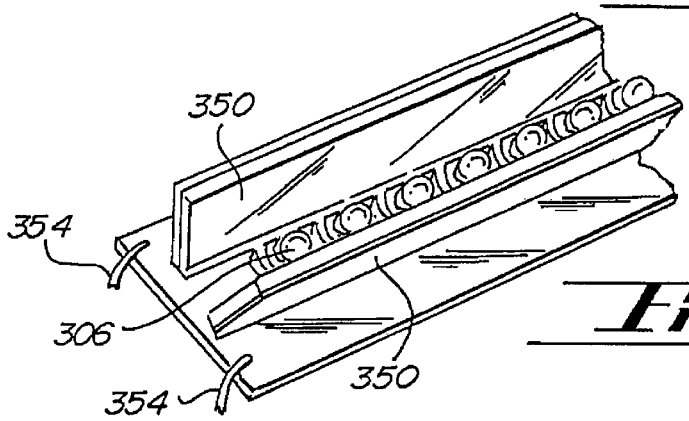
FIG. 19 is an alternative detailed isometric view of a reflector assembly.

As may be seen in FIGS. 15, 16, and 19, in an alternative embodiment, the light bar or light support 302 or panel 304 may be formed of a single row of LED light sources 306. Within this embodiment, the LED light sources 306 are positioned within circular openings 344 of circuit board or LED mounting surface 346 (FIG. 19). Circuit board 346 may be affixed to aluminum base 348 through the use of adhesive including glass beads where the circular openings 344 preferably establish a heat sink for the individual LED light sources 306. The use of adhesive including glass beads to affix the LED light sources 306 and circuit board 346 to the aluminum base 348 preferably assists in the creation of electrical contact for the light bar or light support 302.

As depicted in FIG. 19 the top surface of the circuit board or LED mounting surface 346 may include two reflectors or mirrors 350. The reflectors or mirrors 350 are preferably elongate and are positioned substantially parallel to each other and are adjacent or aligned to the rows of individual LED's 306. The reflectors or mirrors 350 preferably diverge upwardly and outwardly from a position proximate to the LED light source 306 and aluminum base 348. As such, the mirrors 350 have a separation distance which is narrow proximate to the LED light sources 306, where the separation distance becomes larger as the distance vertically from the aluminum base 348 increases.

As earlier described, the brightest or most intense light of the individual LED light sources 306 is provided at an acute angle of approximately 40° to 42°. The reflector or mirror 350 as angled upwardly and outwardly relative to the row of LED light sources 306 reflects light exiting the LED light sources 306 along a desired line of sight which corresponds to perpendicular observation by an individual. The reflectors or mirrors 350 maximize the efficiency of the light sources 306 by reflecting light along the line of sight to be observed by an individual during an emergency situation. The reflectors or mirrors 350 may have a polished or non-polished surface depending on the brightness desired for the light support 302. The reflectors or mirrors 350 may also include one or more reflective sections 374 and/or transparent or clear sections 372. The transparent or clear sections 372 and the reflective sections 374 are described in detail with reference to FIGS. 11–14 herein. It should be noted that the surface of the reflectors or mirrors 350 may include any desired combination of sections, patterns, stripes, rows, and/or columns of clear or transparent sections 372 and/or reflective sections for a reflection of light illuminated from the individual LED light sources 306 during the provision of a warning light signal.

As depicted in FIGS. 20 and 21, the frame 348 includes a base 349. The base 349 may include a holding cavity 358. In the holding cavity 358 is preferably positioned a circuit board or LED mounting surface 360 which includes a plurality of circular openings 344. In each circular opening 344, is preferably positioned an individual LED light source 306. Above the holding cavity 358 is preferably a first support 362 and a second support 363. The first support 362 and second support 363 preferably have an angled interior edge 364. Each angled interior edge 364 is preferably adapted to receive a reflector or mirror 350. Each mirror 350 is preferably utilized to reflect light illuminated from an individual light source 306 along a visual line of sight as depicted by arrow AA of FIG. 21. The first and second supports 362, 363 also preferably include a positioning ledge or notch 366 which is adapted to receive a glass or transparent plastic cover lens 368 which serves as a protector for the frame 348 and individual LED light sources 306.

Figure 12:
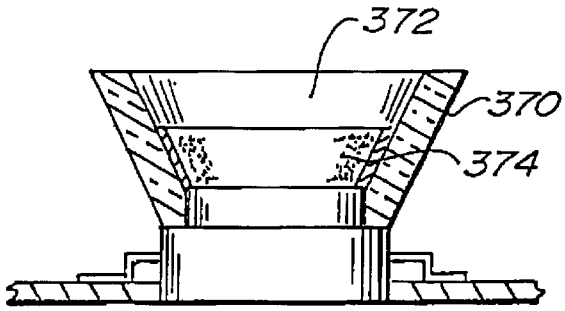
FIG. 12 is an alternative cross-sectional side view of a culminator cup.
Figure 13:
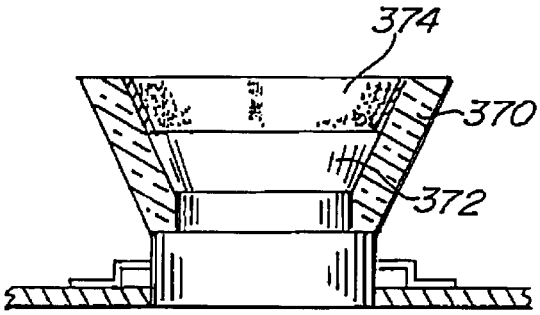
FIG. 13 is an alternative cross-sectional side view of a cullminator cup.
Figure 14:
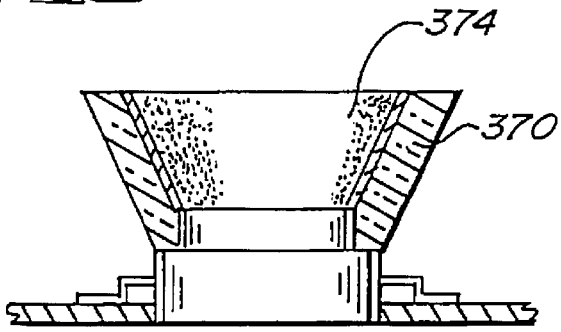
FIG. 14 is an alternative cross-sectional side view of a cullminator cup.

Referring to FIGS. 10–14, a reflector or cullminator for the individual LED light sources 306 is disclosed. The reflector or cullminator is indicated in general by the numeral 370. The reflector or cullminator 370 may be substantially conical in shape and may be configured to encircle an individual LED light source 306. The reflector or cullminator 370 may be partially transparent and have partially cut away side walls. The reflectors 370 may have a clear section 372 and a reflective section 374. In FIG. 13, the clear section 372 is preferably positioned proximate to the LED light source 306 and the reflective section 374 is preferably positioned to the top of the reflector 370.

In FIG. 12, the reflective section 374 is preferably positioned proximate to the LED light source 306 and the clear section 372 is preferably positioned to the top of reflector or cullminator 370. As may be seen in FIG. 14, the entire interior surface of the reflector or cullminator 370 may be formed of a reflective section 374. It should be noted that any combination of clear sections 372 and reflective sections 374 may be utilized. It should be noted that a plurality of clear sections 374 may be utilized within each reflector or cullminator 370.

The use of a combination of clear sections 372 and reflective sections 374 enable an individual to select a configuration for the provision of partial illumination along an angle which is not parallel to a desired line of sight. An individual may thereby be able to observe an illuminated light signal from the side or top of a light bar or light support 302 as opposed to being aligned with a desired line of sight.

Each of the cullminator or reflector cups 370 preferably includes an angled interior surface which extends upwardly and diverges outwardly from a central opening 394. Each central opening 394 is preferably constructed and arranged for positioning proximate to and over an LED light source 306. Each of the cullminator or reflector cups 370 also preferably includes an angled exterior surface which extends upwardly and diverges outwardly from a bottom or base which is preferably positioned proximate to an LED mounting surface or circuit board 346.

Figure 10:
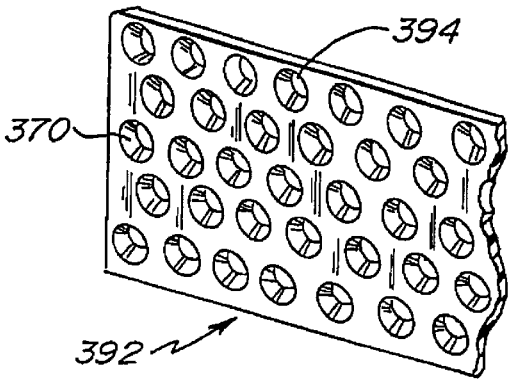
FIG. 10 is a detailed isometric view of a reflector or culminator.
Figure 11:
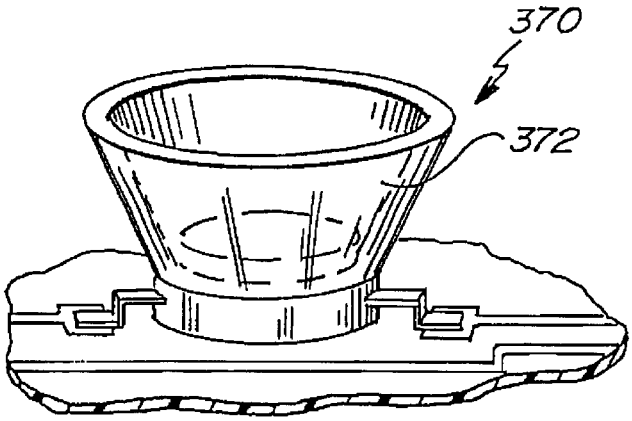
FIG. 11 is a detailed isometric view of a culminator cup.

Referring to FIG. 10 a plurality of cullminator cups or reflectors 270 may be formed into a cullminator assembly or array 392. The cullminator assembly or array 392 is preferably adapted for positioning over an array of LED light sources 306. Examples of arrays of LED light sources 306 which may be utilized with a cullminator assembly 392 are depicted in any of the embodiments identified herein.

Each cullminator array 392 is preferably formed of a reflective material which has plurality of reflective cups 370 disposed there through. Each opening 394 is adapted for positioning over an LED light source 306. The cullminator array 392 preferably has a sufficient thickness to establish an interior reflective surface having a sufficient dimension to reflect light as emitted from the LED light sources 306. Alternatively, the interior surface of each reflector cup 370 may be entirely or partially coated with reflective material.

A culminator array 392 may be formed in any shape including, but not necessarily limited to, square, rectangular, triangular, linear, circular, oval, and special or other irregular shapes for use in reflecting light emitted from an LED light source 306.

Referring to FIGS. 15 and 16 a modular light support 480 in general includes an LED mounting surface 482 having one or more LED light sources 306, a cullminator assembly 484 and a cover 324.

The LED mounting surface 482 is preferably elongate and includes a plurality of LED light sources 306. In general, one to five LED light sources 306 are disposed in a linear orientation along the LED mounting surface 482 which may be a circuit board as earlier described. The LED mounting surface 482 also preferably includes a first end 486 and a second end 488. An opening 490 is preferably positioned through the LED mounting surface 482 proximate to each of the first end 486 and second end 488.

The cullminator assembly 484 preferably includes a plurality of reflector cup areas 492. The cullminator assembly 484 preferably includes a plurality of support walls 494 and a top surface 496. The cullminator assembly 484 preferably includes a plurality of openings 490. Each of the openings 490 is preferably sized to receivingly position and hold the individual LED light source 306 during assembly of the modular light support 480. The reflector cup areas 492 are preferably equally spaced along the cullminator 484 to correspond to the spacing between the individual light sources 306 as disposed on the LED mounting surface 482.

The cover 324 is preferably transparent permitting transmission of light emitted from the LED light supports 306 therethrough. The cover 324 preferably includes a forward face 498, a pair of end faces 500, a top face 502 and a bottom face 504. Each of the pair of end faces 500 preferably includes a receiving notch 506 which is adapted to receivingly engage the LED light mounting surface 482 during assembly of the modular light support 480. An affixation opening 508 preferably traverses the forward face 498 proximate to each of the pair of end faces 500. A fastener 510 preferably passes through the affixation opening 508 for engagement to the opening 490 to secure the LED mounting surface 482 into the receiving notch 506. It should be noted that the cullminator assembly 484 is then positioned within the interior of the cover 324 where the top surface 496 is proximate to the forward face 498. The illumination of the LED light sources 306 then transmits light through the forward face 498 for observation of an emergency warning light signal.

Specifically referring to FIG. 16 one or more modular light support 480 may be positioned adjacent to each other for the creation of a light bar or light stick 512. The modular light supports 480 and/or light bar or light stick 512 may be coupled to a controller 50 which may independently and/or in combination provide a plurality of independent and visually distinct warning light signals as earlier described. In addition, the controller 50 may provide modulated and/or variable power intensity to the individual LED light sources 306 to establish unique warning light signal effects. It should also be noted that the controller 50 may individually illuminate LED light sources 306 to provide for one or a combination of colored light signals.

Any number of modular light supports 480 may be positioned adjacent to each other to comprise a light bar or light stick 512. It should be further noted that a plurality of modular light supports 480 may be positioned at any location about the exterior or within the interior of a vehicle. In one embodiment each of the individual modular light supports 480 will be electrically coupled to a power supply and controller 50 for the provision of unique individual and visually distinctive warning light signals and combination warning light signals as earlier described.

LED technology enables the selection of a desired wave length for transmission of light energy from the individual LED light sources 306. Any wave length of visible or non-visible light is available for transmission from the LED light sources 306. As such, generally no filters are required for use with individual LED light sources 306. The individual LED light sources 306 may be selected to provide for any desired color normally associated with the use in emergency vehicles such as amber, red, yellow, blue, green and/or white.

It should be further noted that the controller 50 may simultaneously display any number of combinations of warning light signals. For example, the controller 50 may provide for a solitary light signal for transmission from a light source. Alternatively, the controller 50 may effect the transmission of two or more signals simultaneously from the identical light source where a first warning light signal is emitted from one portion of the light source and a second warning light signal is emitted from a second portion of the light source. Alternatively, the controller 50 may alternate the two or more warning light signals where the first area of the light source first transmits a first warning light signal and secondly transmits a second warning light signal. The second area of the light source initially transmits the second warning light signal and then transmits the first warning light signal. Further, the controller may transmit two or more independent and visually distinct warning light signals simultaneously within different areas of light source. The controller 50 may also reverse the warning light signals for simultaneous transmission between different areas of the light source. Further, the controller 50 may regulate the transmission of more than two visually distinct types of warning light signals from a light source at any given moment. The controller 50 may alternate warning light signals within different areas or enable transmission of warning light signals in reverse alternating order for the creation of an infinite variety of patterns of visually distinct warning light signals for use within an emergency situation. The controller 50 may also permit the transmission of a repetitive pattern of warning light signals or a random pattern of visually distinct warning light signals.

Referring to FIGS. 24 through 28, in general, the electrical characteristics of light emitting diodes vary between manufacturing lots. In addition, the electrical characteristics of light emitting diodes vary between colors which emit different wavelengths or frequencies of light. It is generally not economical for a manufacturer of standardized circuitry and/or electrical systems for a light fixture, which include defined and acceptable electrical parameters, to customize electrical circuitry for light emitting diodes which have varying electrical characteristics dependent upon manufacturing lots. It is also cost prohibitive to customize the electrical specifications of each electrical system to optimize performance for light emitting diodes used within an electrical light fixture. It is further cost prohibitive to customize the electrical specifications for an electrical system so that light emitting diodes may operate properly or function within standardized acceptable operational parameters.

A need therefore exists to standardize the electrical specifications of light emitting diodes for first satisfaction of the electrical requirements of a standardized electrical system and second to optimize performance of the light emitting diodes without damage to an electrical system which may occur as a result of increased heat and/or burnout of the light emitting diodes.

Light emitting diodes degrade over time. To compensate for the degradation of light emitting diodes, increased current and/or an increased duty cycle is exposed to the light emitting diodes to maintain an optimized level of illumination. At a certain time, the degradation of the light emitting diodes will advance where additional input of current and/or an increased duty cycle will not compensate for the deterioration of light output necessitating replacement of the LED module.

In order to attempt to solve the above-identified problems, each batch and/or manufacturing lot of light emitting diodes is initially screened or tested to determine specific electrical characteristics which may then be separated into groups.

The number of groups of light emitting diodes may vary where more or fewer groups may be established as needed dependent upon the requirements of the electrical system to utilize the light emitting diodes. For example, the electrical schematics and electrical parameters for a light bar may be known. The electrical schematics and electrical requirements for a light bar will preferably include a known window of acceptable specifications for a replaceable LED module 600 (FIG. 15). The replaceable LED module 600 thereby provides a desired level of performance within the electrical system for the LED light bar.

The initial screening or testing of manufacturing lots and/or batches of light emitting diodes also determines whether the electrical characteristics for the light emitting diodes are outside of the specifications for use within the standardized electrical system on either the high or low voltage sides. A compensator 614 may be used to initially adjust the electrical parameters for the LED'S to reduce or enlarge the voltage and/or current draw for inclusion of a replaceable LED module 600 into the electrical system for a light fixture such as a light bar. The replaceable LED module 600 thereby conforms to the standardized electrical requirements for the electrical system to provide optimized performance.

In general, the compensator 614 tunes the particular batch and/or manufacturing lot of light emitting diodes for balancing of the electrical characteristics of the replaceable LED module 600. The replacement LED module electric circuit is therefore balanced and/or adjusted to the electrical specifications of the pre-manufactured fixture circuitry.

An initial compensator 614 may be a diode, zener diode, resistor, and/or transistor used to modify the electrical characteristics of a series of light emitting diodes 608, 610, 612, for inclusion within the specifications of the electrical system circuitry for pre-manufactured light fixtures.

A variety of zener diodes are available to adjust a series of light emitting diodes 608, 610, 612, which have been previously screened for electrical discrepancies. A particular zener diode may be selected for connection in series with a plurality of LED's 608, 610, 612, to compensate for current or voltage discrepancies. The compensation for electrical discrepancies caused by individual LED's 608, 610, 612, and/or standardization for inclusion within electrical specifications occurs prior to the inclusion of the replacement LED module 600 within a light fixture such as a light bar. The compensator 614 balances each of the replacement LED modules 600 in order to conform to standardized specifications for the light fixture and to optimize performance of the light emitting diodes during the provision of illumination.

The prescreening of the individual light emitting diodes 608, 610, and 612, as included within the replacement LED module 600 are initially categorized according to a measured forward voltage. The forward voltage measurement summarizes a forward voltage drop for a given level of current input.

The replacement LED modules 600 are initially formed of three light emitting diodes from an identical manufacturing lot and/or batch. The light emitting diodes 608, 610, 612, generally are of the same color. The light emitting diodes 608, 610, 612, are formed into the replacement module 600 which is then tested at 350 ma (milliamps) DC. The forward voltage drop is then recorded. Generally, the forward voltage drop range is between 6.6 volts to 10.3 volts. The wide range of forward voltage drop does not, in all cases, conform to the electrical specifications and/or parameters for the standardized pre-manufactured electrical system for a light fixture such as the light bar. The use of a zener diode 614 in series with the light emitting diodes 608, 610, 612, adjusts and/or tunes a desired amount of current/forward voltage to the replacement LED module 600. The zener diodes 614 provide a reverse current voltage drop which is utilized to tune the replacement LED module 600.

For example, initial screening of batches and/or manufacturing lots of light emitting diodes 608, 610, and 612, may be categorized into groups where the first group has a forward voltage drop of approximately 6.6 v to 7.3 v; a second category has a forward voltage drop of approximately 7.4 v to 8.0 v; a third category has a forward voltage drop of approximately 8.1 v to 8.7 v; a fourth category has a forward voltage drop of approximately 8.9 v to 9.5 v; and a fifth category has a forward voltage drop of approximately 9.6 v to 10.3 v.

A reverse current voltage drop zener diode 614 would be used in the first, second, third, and fourth categories. The fifth category would not require the use of reverse current voltage drop zener diode 614 because a forward voltage drop of approximately 9.6 v to 10.3 v satisfies the initial electrical operational specifications for the electrical driving system of the light fixture.

Figure 24:
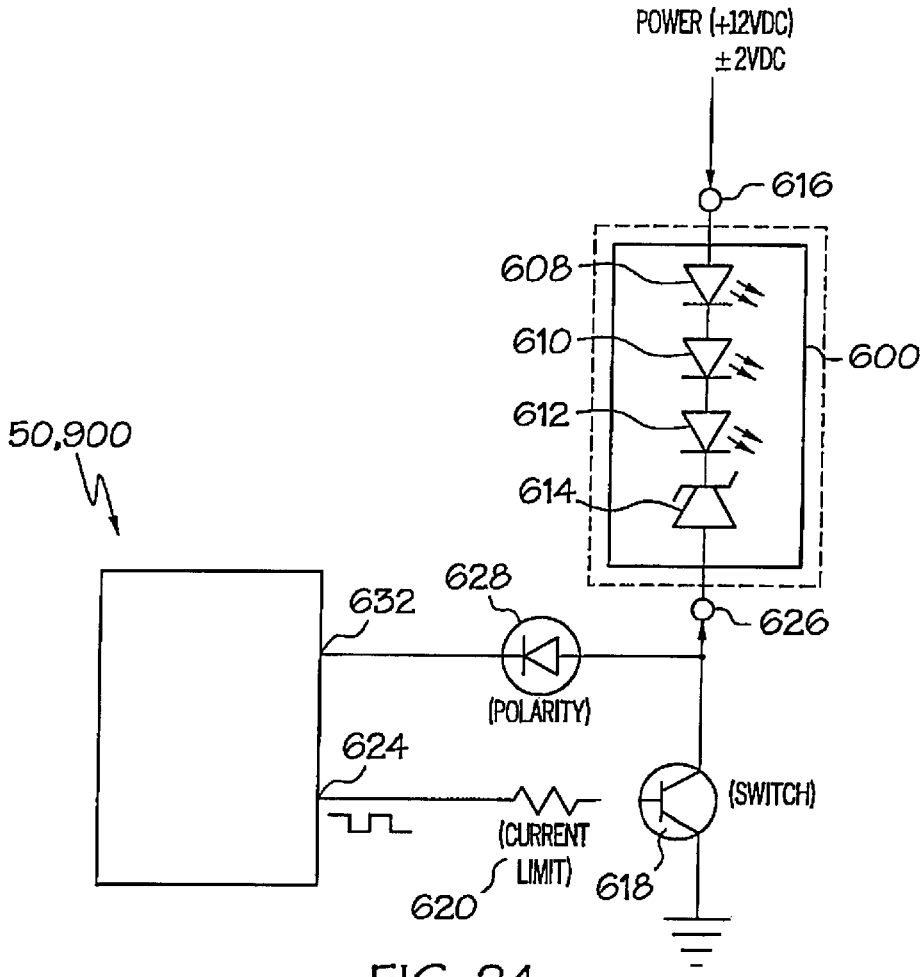
FIG. 24 is an electrical schematic of a replacement LED module with compensator.
Figure 25:
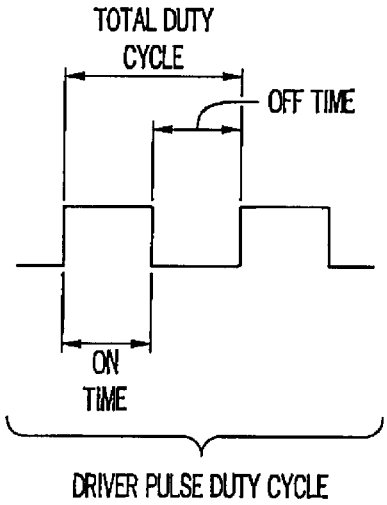
FIG. 25 is a detailed graph of an LED duty cycle.
Figure 26:
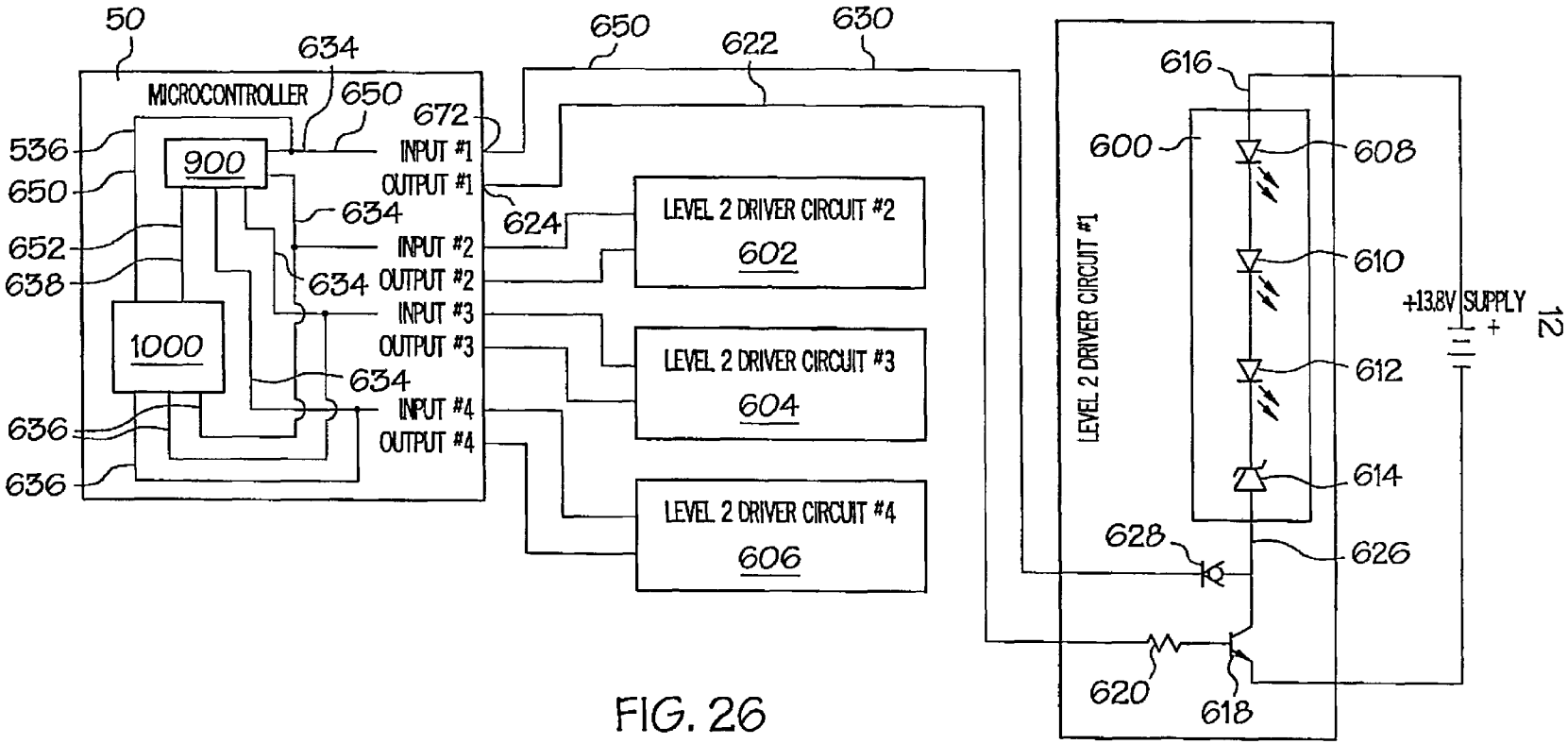
FIG. 26 is an electrical schematic partial block diagram of the circuit of FIG. 24 connected to a controller and electrical system of a light fixture.

Referring to FIGS. 24 through 26, a replacement LED module 600 is generally disclosed. The replacement LED modules 600 preferably includes a plurality of light emitting diodes 608, 610, and 612, electrically coupled in series. A zener diode 614 is also preferably electrically connected to the light emitting diodes 608, 610, and 612, in series. The zener diode 614 may be replaced by a resistor, transistor, and/or diode provided that the replacement compensator 614 tunes and/or adjusts the prescreened electrical characteristics for the replacement LED light module 600 for inclusion within standardized specifications for the electrical system of a light fixture. In the past, it has been determined that the use of a resistor as the compensator 614 produces the complication of excess heat which is required to be dissipated to avoid collateral damage to electronic circuitry. Diodes have been selected for the compensator 614 to function as a passive component such as a resistor without developing excess heat within the light fixture housing which is required to be dissipated.

Many different types of zener diodes 614 are available to function as a compensator within the replacement LED module 600. The replacement LED module 600 may include one or more zener diodes 614 in series, and/or in parallel to tune and/or adjust the prescreened electrical parameters to conform to electronic specifications for the light fixture. In general, zener diodes 614 are available having any desired level of a reverse current constant voltage drop. The forward current constant voltage drop of a zener diode 614 is approximately 0.7 volts. The maximum power dissipated by the zener diode 614 is preferably characterized by an equation defined as the maximum power equals the maximum current rating times the reverse current constant voltage drop.

A zener diode 614 will preferably be selected for each of the above-identified categories 1 through 4. For example, for category 1, a zener diode 614 having a reverse current constant voltage drop of approximately 3.0 v; a zener diode 614 would be selected for category 2 which would likely have an approximate reverse current voltage drop of 2.2 v; a zener diode 614 would be selected for category 3 which would likely have an approximate reverse current constant voltage drop of 1.5 v; and a zener diode 614 would be selected for category 4 which would likely have an approximate reverse current constant voltage drop of 0.7 v.

As may be seen in FIG. 24, the replacement LED module 600 preferably includes an electrical input 616 and an electrical output 626. The microcontroller 50, 900, preferably includes an input 632 and an output 624. The input 632 preferably constantly senses the current passing through the replacement LED module 600. The replacement LED module 600 in the optimum mode allows current flow in the range of 250 ma to 450 ma. If the current monitored through the LED replacement module 600 is greater than 450 ma, then the microcontroller 900 switches to decrease the current, where the duty cycle for the replacement LED module 600 is lowered by approximately 20%. If the current monitored through the replacement LED module 600 is less than 250 ma, then the microcontroller switches to increase the current and duty cycle of the replacement LED module 600 by approximately 20%. The amount of energy, or power consumed by the replacement LED modules 600 is generally between 2.4 watts to 4.6 watts per replacement LED module 600. The microcontroller 900 preferably regulates the current provided to the replacement LED module 600 such that current draw remains in the range of 250 ma to 450 ma. The power consumed by the replacement LED module 600 may be calculated using the equation: power=voltage×current.

Referring in detail to FIG. 26, the controller 50, microcontroller 900 is shown as a block diagram. The controller 50, microcontroller 900 is in communication with replacement LED modules 600, 602, 604, and 606. Replacement LED modules 600, 602, 604, and 606, in general are each formed of three light emitting diodes 608, 610, and 612, connected in series. A zener diode 614 as earlier described is connected in series to each light emitting diode 612. Light emitting diodes 608, 610, and 612, are preferably of the same color and/or wavelength as earlier described. The color of the light emitting diodes 608, 610, and 612, are not required to be identical between replacement LED modules 600, 602, 604, and 606. Replacement LED module 600 has a current input 616 which is connected to a power supply of approximately 12 volts which may be plus or minus two volts as indicated in FIG. 26 and FIG. 24. The input 616 is electrically connected to a switch 618 which may be a switching transistor. The input 616 may further be electrically coupled to a resistor 620 which is electrically upstream from the switch 618. It should be noted that the resistor 620 is optional as well as the transistor as a portion of the switch 618. The resistor 620 in the circuit as indicated in FIG. 26 is preferably rated for 500 ohms. An electrical connector 622 is preferably coupled to the output 624 of controller 50. The replacement LED module 600 preferably includes an output 626 which is in electrical communication with a microcontroller 50, 900, which functions as a sensor. The microcontroller 50, 900, preferably functions as a measuring component to analyze the voltage exiting from the LED replacement module 600. The microcontroller 50, 900, is preferably in communication with a second electrical connector 630, which in turn is electrically coupled to an input 632. The electrical elements for the replacement LED modules 600 are preferably duplicated within modules 602, 604, and 606.

A third electrical connector 634 preferably provides a communication pathway between the input 632 and the compensating software 900. A fourth electrical connector 636 preferably provides a communication pathway between the input 632 and a data or look-up table 1000 of microcontroller 50. A fifth electrical connector 638 preferably provides a communication pathway between the data or look-up table 1000 and the compensating software 900.

In operation, the microcontroller 50 generates a duty cycle with a corresponding current draw of between 250 ma and 450 ma through the LED's. The signal passes through resistor 620 and activates switch 618 for current entry into replacement LED module 600 at input 616. The current then passes through LED's connected in series 608, 610, and 612, to provide visual illumination. The current then passes through the initial compensator 614 which is preferably a zener diode having the electrical features and characteristics as earlier described. The current then exits through the transistor to the ground of the power supply. Diode 628 preferably has a forward voltage of 0.7 volts which eliminates feedback into the replacement LED module 600. The diode 628 preferably does not have a reverse current constant voltage drop as earlier described.

The sensed current exiting the replacement LED module 600 is preferably transmitted to the microcontroller 50, 900, through the second electrical connector 630. The microcontroller 50, 900, assigns the value of the current exiting the replacement LED module 600 as a first signal 650 for processing within compensating software 900. The first signal 650 is preferably communicated to the compensating software 900 through the third electrical connector 634. The first signal 660 is also communicated to a data or look-up table 1000 through the fourth electrical connector 636. The microcontroller 50 preferably analyzes the first signal 650 to identify the type, frequency, and/or color of light emitting diodes 608, 610, and 612 to compare to prestored data within the data or look-up table 1000. The controller 50 then generates a second signal 652 for communication through the fifth electrical connector 638 to compensating software 900. Current analysis values 640, 642, (FIG. 27) are thereby established for analysis by the compensating software 900. The compensating software 900 processes the first signal 650 received through the third electrical connector 634 according to the parameters received from data or look-up table 1000 via the fifth electrical connector 638. The controller 50 following processing by the compensating software 900 may therefore increase and/or decrease the current to be generated from output 624 via the first electrical connector 622 to the input 616 into the replaceable LED module 600.

This sensing and compensating cycle may continuously occur or be implemented by a timing circuit 908 at regular or irregular intervals.

In general, the compensating software 900 is utilized to increase the pulse width or frequency of the replacement light emitting diode 600 as the voltage drop and/or decay/increase over time to maintain optimization of light output without burning of the light emitting diodes 608, 610, and/or 612, out. The compensating software 900 preferably uses look-up table 1000 to identify appropriate current, and to select a predetermined pulse width, based upon an identified type and/or color of light emitting diode 608. The compensating software 900 determines optimum current and adjusts maximum frequency for a given pulse width for the light emitting diodes 608, 610, or 612.

In general, the compensating software 900 first compares a known input voltage to a measured output voltage for comparison to the look-up table 1000 to determine whether an increase, decrease, or no adjustment to the duty cycle of the replacement LED module 600 is required. The microcontroller 50 further assigns a location identifier to each replacement LED module 600, 602, 604, 606, to effectuate location tracing to increase, decrease, or leave the applied duty cycle the same at the respective LED module 600. The analysis of a voltage drop related to the replacement LED module 600 provides a benchmark for comparison to the data contained in the lookup table 1000 to identify specific operational parameters for the compensating software 900 for adjustment of any required current gain.

The microcontroller 50 and/or compensating software 900 permits passage of a known current through the replacement LED module 600, where the microcontroller 50 and/or compensating software 900 measures the current draw.

The signal provided to the replacement LED module 600 is represented as a square wave or greer wave (FIG. 25) having an elevated section which represents an increased level of current being supplied to the appropriate diodes 608, 610, and 612. The control and provision of power turns the resistor/transistor 618 on, bringing it to ground. The more current that the diodes 608, 610, and/or 612, draw, the less the voltage will be at output 626. The voltage downstream or lower than the LED's 608, 610, 612, is sensed by microprocessor 50 at point 632 to determine whether the LED's 608, 610, 612, represent a blue module, a green module, a red module, or an amber or other colored module light source. The controller 50 then implements a compensating programming function 900 where the controller 50 assigns a location 650 and selects an appropriate voltage 640, 642 to correspond to an optimized duty cycle or level of performance for the color of the diode at the assigned location.

The circuit senses and assesses, selects, or calculates the correct level of power and correct duty cycle for each replacement LED module 600 independently of other replacement LED modules 602, 604, 606. Therefore, an individual may elect to replace and change an LED light source module 600 or LED light source color module 600 in any combination across an elongate or short light source.

Differences exist in the electrical characteristics of LED's 608, 610, and 612, and LED assemblies 600 which therefore, require the adjustment of the current level for different duty cycles based upon a red, amber, green, or blue LED light source 608, 610, 612. A blue LED light source will have a different forward voltage than a red LED light source. The cycle for a blue LED light source may have an elongated duty cycle compared to the duty cycle for a red LED light source, therefore, necessitating an increased current level to optimize performance for the blue LED light source. When the controller 50 senses a blue LED light source due to the sensed voltage drop at 632 as compared to a look-up table 1000, the duty cycle may be increased and therefore the controller 50 senses and applies a correct current voltage. In general, a longer duty cycle requires more voltage to maintain the blue at optimum operating capacity. A shorter duty cycle and less current is required for a red LED light source. The controller 50 repeatedly performs a voltage check at regular intervals at 632. In general, a two kilohertz frequency during the duty cycle will provide the appropriate current or power for the system. This check may be run at predetermined intervals which may be initialized upon the start-up of the replacement LED light source 600. Intermittent verification may also be implemented at the discretion of an individual. Verification is important to maximize light output for each of the light sources 608, 610, and 612. The purpose for the circuit is to solve the problem associated with different colors requiring different current draw in order to operate at optimum capacity. Blue light requires a much greater level of energy to produce an acceptable light signal as compared to red light. The bluer the wavelength, the more energy it takes to operate at maximum efficiency, therefore, a blue light signal inherently draws more current.

The purpose of having the circuit is that each replacement LED module 600, 602, 604, and/or 606, depending on its color, requires different duty cycles, blue being a higher energy, shorter wavelength, requiring a higher current as opposed to a red light signal which requires a lower current. For example, a replacement blue module placed into a red slot would literally under drive the blue LED module. A red module replacing a properly driven blue module would likely overdraw and damage the red module, consequently, a blue module replacing a red module would likely receive less current which would reduce the optimum performance for the blue module. The disclosed compensating software 900 automatically senses and adjusts the current needs at specific modules 600, 602, 604, and 606 to automatically optimize current, regardless of the color of the LED's, and even regardless as to whether or not the colors of the LED's are mixed. An individual may therefore substitute and/or replace different colored LED modules 600, 602, 604, 606, at will where the circuit will sense the location of the substituted or replacement LED modules 600, 602, 604, and/or 606, for control of a correct current level and/or power output for each location to optimize performance of a light fixture.

Figure 27:
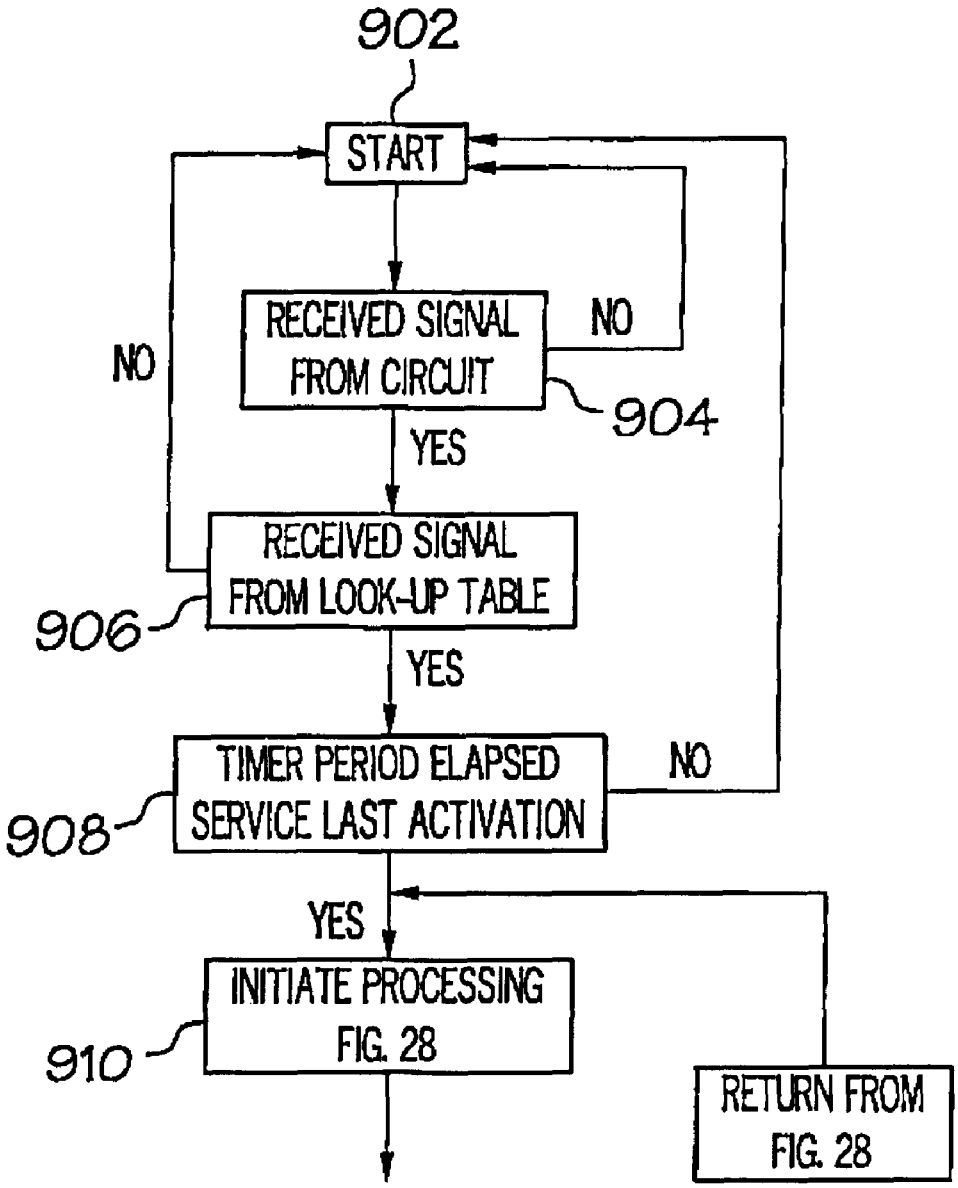
FIG. 27 is a block diagram of software utilized to initiate further processing within compensating circuitry.

Referring to FIG. 27 the software for initiation of the compensating software 900 is disclosed. Initially, the compensating software 900 will receive the first signal 650 from the input 632 and the second signal 652 from the look-up data table 1000 at the start 902. The compensating software 900 then recognizes receipt of the first signal 650 at 904. If the first signal 650 is not recognized or received, then the processing returns to the ready state at 902. If the first signal 650 is recognized then the processing continues to 906. At 906 the compensating software 900 recognizes receipt of the second signal 652 from the look-up table 1000. If the second signal 652 is not recognized and/or received then the processing returns to the ready state at 902. Following receipt of the first signal 650 and the second signal 652 processing continues to a timer 908. Timer 908 determines if a preset period of time has elapsed between the present time and the last activation time of the compensating software 900. If sufficient time has elapsed, then timer 908 initiates compensation processing as identified in FIG. 28 by allowing the first signal 650 and the second signal 652 to enter compensating software 900 at 910.

Figure 28:
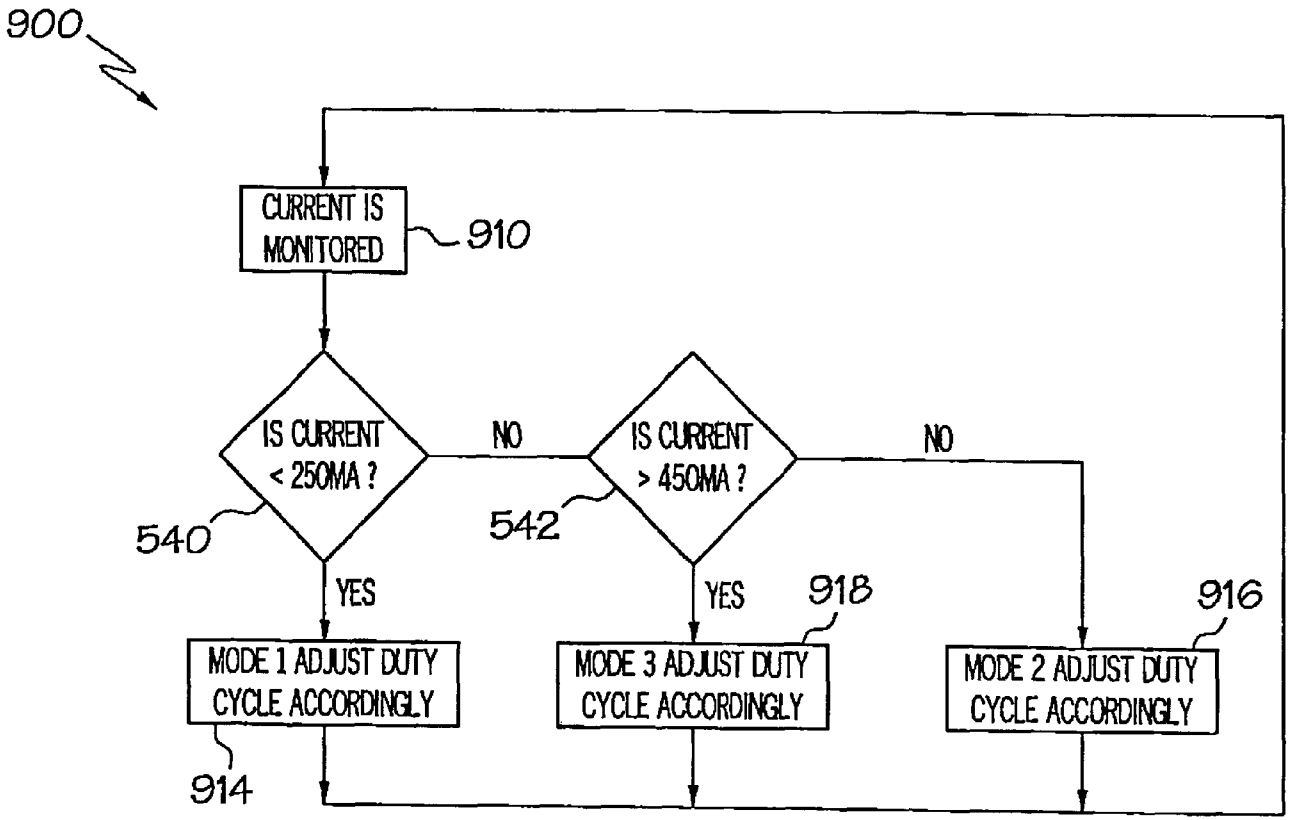
FIG. 28 is a block diagram of the software utilized by the controller/microprocessor for driving the compensation circuitry.

Referring to FIG. 28, at 910 the second signal 652 includes the first current analysis value 640 and the second current analysis value 642. The first signal 650 representative of the current at 632 is then compared to the first current analysis value 640. If the first signal 650 is less than the first current analysis value 640 then an increased current signal is created at 914. If the first signal 650 is not less than the first current analysis value 640 then the first signal 650 is compared to the second current analysis value at 642. If the first signal 650 is less than or equal to the second current analysis value 642 then a passing range signal is created at 916 which communicates to controller 50 and/or microcontroller that no current adjustment is required by the compensating software and/or circuit 900. If the first signal 650 is more than the second current analysis value 642, then a decreased current signal is created at 918. The processing cycle may be continuous or occur at intervals established by the timer 908.

The first current analysis value 640 and the second current analysis value 642 may vary dependent upon the make, lot, batch, and/or color of LED's 608, 610, and/or 612, used within replacement LED module 600. The controller 50 or microcontroller initially senses the first signal 650 and compares the first signal 650 to the prestored data in the look-up table 1000 to retrieve the first current analysis value 640 and the second current analysis value 642 for communication to the compensating software 900.

In addition, controller/microcontroller 50 initially assigns a location identifier to the respective LED modules 600, 602, 604, or 606, during processing of the first signal 650 and second signal 652. The location and/or position identifier thereby enables the increased current signal 914, passing range signal 916, and/or decreased current signal 918 to be processed by controller/microcontroller 50 for tracking to corresponding replacement LED modules 600, 602, 604, and/or 606. Individual and/or independent current compensation is thereby provided between replacement modules 600, 602, 604, and/or 606.

As show in FIG. 28 the first current analysis value 640 is set at 250 ma and the second current analysis value 642 is set at 450 ma. The value to be utilized as a first and second current analysis values 640, 642, may vary according to the information and/or data which is prestored in the look-up table 1000.

The increased current signal 914 and the decreased current signal 918 are preferably set as a percentage of the first signal 650. The percentage assigned to the increased current signal 914 and the decreased current signal 918 may be identical and/or different. It is anticipated that the increased current signal 914 and the decreased current signal 918 will initially be set at 20% of the value of the first signal 650. A larger and/or smaller percentage is available dependent upon the electrical parameters for the electrical system of the LED light signaling fixture.

During operation, either the increased current signal 914 and/or the decreased current signal 918 will be received by the controller/microcontroller 50 to upwardly and/or downwardly adjust the current to exit the output at 624 for entry into the LED replacement module 600 at 616. Alternatively, upon receipt of the passing range signal 916 the controller/microcontroller 50 will not adjust upwardly and/or downwardly the current to exit the output at 524. The controller/microcontroller 50 through the compensating software 900 regularly monitors and/or adjusts the current and/or duty cycle of the light emitting diodes 608, 610, and/or 612, of each of the replacement LED modules 600, 602, 604, and/or 606, to optimize illumination characteristics for an LED light signaling fixture. It should be noted that the power source for the replacement LED module 600 and compensation software circuit described herein is a constant input, non-variable or degrading power source. The compensating software 900 discussed herein is concerned with power reduction and/or degradation of replacement LED module 600 and is not focused upon the degradation of a power source such as a battery.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below (e.g. claim 3 may be taken as alternatively dependent from claim 1; claim 4 may be taken as alternatively dependent on claim 1, or on claim 2; etc.).

The disclosure is intended to be illustrative and not exhaustive. This description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed is:

1. A Light emitting diode compensating circuit comprising:

A. a current input electrically coupled to a substantially constant power source;

B. a plurality of light emitting diodes connected in series, said light emitting diodes being connected to said power source;

C. a signal input electrically downstream from said light emitting diodes, said signal input being constructed and arranged to transmit a current drop occurring across said light emitting diodes upon exposure to said power source; and D. at least one controller comprising processing software and a look-up table having stored data representative of electrical specifications for combinations of light emitting diodes, said controller being constructed and arranged to access said look-up table for identification of at least one current analysis value, said controller in communication with said signal input, said controller being electrically coupled to said current input, said processing software being constructed and arranged to analyze and process said current drop compared to said at least one current analysis value and to adjust power provided to said light emitting diodes.

2. The compensating circuit according to claim 1, wherein said look-up table comprising data representative of electrical specifications of light emitting diodes of different colors.

3. The compensating circuit according to claim 2, wherein said controller is constructed and arranged to illuminate said light emitting diodes for the provision of different types of light signals.

4. The compensating circuit according to claim 3, wherein said controller is constructed and arranged to illuminate said light emitting diodes for the provision of a plurality of combinations of light signals.

5. The compensating circuit according to claim 4, wherein said light emitting diodes are of the same color.

6. The compensating circuit according to claim 5, wherein said light emitting diodes are from the same manufacturing lot.

7. A Light emitting diode compensating circuit comprising:

A. a current input electrically coupled to a substantially constant power source;

B. a plurality of light emitting diodes connected in series, said light emitting diodes being connected to said power source;

C. a signal input electrically downstream from said light emitting diodes, said signal input being constructed and arranged to transmit a current drop occurring across said light emitting diodes upon exposure to said power source;

D. at least one controller in communication with said signal input, said controller being electrically coupled to said current input, said controller being constructed and arranged to process said current drop and to adjust said power provided to said light emitting diodes; and E. a compensator electrically connected to said light emitting diodes downstream from said light emitting diodes and electrically upstream from said signal input said compensator being constructed and arranged to initially alter the current drop across said light emitting diodes wherein said compensating circuit conforms to the electrical specifications for an electrical fixture.

8. The compensating circuit according to claim 7, wherein said alteration of said current drop across said light emitting diodes occurs prior to the provision of power to said light emitting diodes.

9. The compensating circuit according to claim 8, wherein said compensator comprising a zener diode.

* * * * *